US012564757B2

(12) United States Patent
Gastel

(10) Patent No.: US 12,564,757 B2
(45) Date of Patent: Mar. 3, 2026

(54) EXERCISE APPARATUS, SYSTEM, AND METHOD

(71) Applicant: Stellar Innovations LLC, Lincoln, RI (US)

(72) Inventor: Jonathan Gastel, Lincoln, RI (US)

(73) Assignee: Stellar Innovations LLC, Lincoln, RI (US)

( * ) Notice: Subject to any disclaimer, the term of this patent is extended or adjusted under 35 U.S.C. 154(b) by 114 days.

(21) Appl. No.: 18/655,759

(22) Filed: May 6, 2024

(65) Prior Publication Data

US 2024/0366993 A1 Nov. 7, 2024

Related U.S. Application Data

(60) Provisional application No. 63/464,530, filed on May 5, 2023.

(51) Int. Cl.

| | |
|---|---|
| ***A63B 21/00*** | (2006.01) |
| ***A63B 23/04*** | (2006.01) |
| ***A63B 69/00*** | (2006.01) |
| ***A63B 69/18*** | (2006.01) |
| ***A63B 71/00*** | (2006.01) |

(52) U.S. Cl.

CPC .... *A63B 21/4034* (2015.10); *A63B 21/00047* (2013.01); *A63B 21/4007* (2015.10);

(Continued)

(58) Field of Classification Search

CPC ..... A63B 21/00047; A63B 21/022; A63B 21/0407; A63B 21/0414; A63B 21/0421;

(Continued)

(56) References Cited

U.S. PATENT DOCUMENTS 3,929,329 A 12/1975 Rivera
4,779,862 A 10/1988 Keppler (Continued)

FOREIGN PATENT DOCUMENTS

CN 112807640 B 1/2022
CN 112569559 B 3/2022

(Continued)

OTHER PUBLICATIONS

International Search Report and Written Opinion for PCT Patent Application No. PCT/US2024/027964, mailed Sep. 20, 2024.

(Continued)

*Primary Examiner* — Gary D Urbiel Goldner
(74) *Attorney, Agent, or Firm* — Adler Pollock & Sheehan P.C.

(57) ABSTRACT

An exercise apparatus, system, and method includes a board with adjustable bumpers having shock-absorbing systems and user-adjustable bumper push-off angles. A counterforce and guiding system provides an amount of counterbalance force corresponding to an amount of force by an amount of a user lean during a sliding motion, while simultaneously providing an amount of a guiding force from a harness not affixed statically to a user. This allows for a gliding motion along a path, with a guideline to guide an amount of a user motion corresponding to a user-selected path of motion on a top sliding surface as the user slides. This results in the user simulating a dynamic of a naturally occurring posture and motion of a human body optimized for performing the gliding motion corresponding to the user-selected path of motion.

15 Claims, 9 Drawing Sheets

(52) U.S. Cl.
CPC ..... *A63B 23/04* (2013.01); *A63B 69/0022* (2013.01); *A63B 69/182* (2013.01); *A63B 71/0054* (2013.01); *A63B 2071/0063* (2013.01); *A63B 2208/0204* (2013.01); *A63B 2214/00* (2020.08); *A63B 2225/09* (2013.01); *A63B 2244/183* (2013.01); *A63B 2244/186* (2013.01)

(58) Field of Classification Search
CPC ..... A63B 21/0428; A63B 21/0435; A63B 21/0442; A63B 21/152; A63B 21/169; A63B 21/4007; A63B 21/4009; A63B 21/4034; A63B 22/0023; A63B 22/0046; A63B 23/04; A63B 23/0405; A63B 23/0488; A63B 2023/0411; A63B 69/0022; A63B 69/0059; A63B 69/18; A63B 69/182; A63B 71/0054; A63B 2071/0063; A63B 2071/0072; A63B 2208/0204; A63B 2209/00; A63B 2214/00; A63B 2225/09; A63B 2225/093; A63B 2244/18; A63B 2244/183; A63B 2244/186; A63B 2244/19
See application file for complete search history.

(56) References Cited

U.S. PATENT DOCUMENTS

| | | | | | |
|---|---|---|---|---|---|
| 4,940,226 | A | | 7/1990 | Carra | |
| 5,052,682 | A | | 10/1991 | Croce, Jr. et al. | |
| 5,114,387 | A | | 5/1992 | Keppler | |
| 5,133,700 | A | | 7/1992 | Braathen | |
| 5,326,338 | A | * | 7/1994 | Makous | A63B 22/20 434/253 |
| 5,328,427 | A | * | 7/1994 | Sleamaker | A63B 69/0022 482/110 |
| 5,342,260 | A | | 8/1994 | Markland | |
| 5,393,282 | A | | 2/1995 | Maclean | |
| 5,509,870 | A | | 4/1996 | Lloyd | |
| 5,593,370 | A | | 1/1997 | Meldeau | |
| 5,800,312 | A | | 9/1998 | Ormondroyd | |
| 8,118,599 | B2 | * | 2/2012 | Lipetz | A63B 69/0022 434/255 |
| 11,806,574 | B2 | | 11/2023 | Janowski | |
| 2011/0152036 | A1 | * | 6/2011 | Halver | A63B 21/157 482/51 |

FOREIGN PATENT DOCUMENTS

| | | | | | |
|---|---|---|---|---|---|
| DE | 102004054051 | A1 | * | 5/2006 | A63B 21/4009 |
| FR | 2637190 | A1 | * | 4/1990 | A63B 69/0035 |
| KR | 101540591 | B1 | | 7/2015 | |
| WO | WO-2019011281 | A1 | * | 1/2019 | A63B 71/06 |
| WO | WO-2019011282 | A1 | * | 1/2019 | A63B 69/18 |

OTHER PUBLICATIONS

"6 Ft. Adjustable Slide Board + Free Workout," The Brrrn Shop, downloaded from https://thebrrrn.com/products/brrrn-board-adjustable-5-6ft, Mar. 7, 2024.

* cited by examiner

EXERCISE APPARATUS, SYSTEM, AND METHOD

CROSS-REFERENCE TO RELATED APPLICATIONS

This application claims the benefit of priority to U.S. Provisional Patent Application No. 63/464,530, filed May 5, 2023, the disclosure of which is incorporated by reference herein in its entirety.

FIELD

The present disclosure relates generally to exercise apparatus. More specifically the present disclosure is directed to slide exercisers that provide for the exercise of the human body.

BACKGROUND

Hockey players, speed skaters, skiing athletes, cross-training fitness athletes, rollerblade enthusiasts, and other athletes have been using conventional slide boards for fitness training purposes. These conventional slide board devices provide for training of the lateral movement musculature to improve strength and conditioning for the athletes.

For example, U.S. Pat. Nos. 4,779,862 and 5,114,387 to Keppler disclose conventional slide boards developed primarily as exercisers for speed skaters and similar athletes. The basic apparatus has a rectangular base covered with a plastic sheet with a smooth glide surface bounded at two sides by a bumper at each end of the sheet. The bumpers are attached in parallel at opposite ends of a base along two shorter sides of a rectangle. A user wearing appropriate footwear (socks or shoe covers) can slide along the plastic sheet in a straight lateral motion, side to side, until one-foot contacts a bumper. Upon impacting the bumper, the user pushes with the leg contacting the bumper and can slide along the plastic sheet in the opposite direction until the other user's foot contacts the second bumper. By alternately pushing off of one bumper towards the other bumper in a straight lateral motion, side to side, the user exercises the lateral movement musculature of the legs.

Keppler's slideboard apparatus have rigid bumpers and removable members that clamp to the ends of the base. The bumpers are mounted parallel to each other and have vertical surfaces designed to receive the impact of the user's sliding feet. However, these conventional slide board apparatuses have many problems due to their structural configuration including the vertical bumpers. For example, users using vertical bumpers found that these types of bumpers have caused considerable and adverse impact pressures and stresses on the user's foot, ankle, and knee. During impact, the fifth metatarsal of the foot contacts the rigid vertical wall of the bumper. This initial impact causes bruising of the side of the foot, which eventually results in user discomfort and diminishes the utility of the slide board. If continued contact, specifically continued contact of the amount of impact force on the user's sliding feet against the bumper continues, unwanted lateral pressure increases on the subtalar joint and the knee, stressing the lateral collateral ligament, along with other injuries such as damage to the user's joints.

Keppler attempted to overcome these disadvantages somewhat in the U.S. Pat. No. 5,114,387, by providing an inclined plane attached to and adjacent to the bumper. The ramp section of the bumper was inclined at an angle relative to the horizontal plane such that the ball of the foot, rather than the metatarsal bones, contacted the bumper. The reason for these modifications was to reduce the amount of side impact force and lateral stresses, wherein on deceleration, the ball of the user's foot would contact the bumper and the user's ankle would attempt to evert to the angle of the inclined plane bumper.

These disadvantages were somewhat addressed in the second Keppler, U.S. Pat. No. 5,114,387. This patent disclosed a slide board having an inclined plane attached to and adjacent to the bumper. The ramp section of the bumper is inclined at an angle relative to the horizontal plane, such that the ball of the foot, rather than the metatarsal bones, contacts the bumper. Thus, side impact pressure and lateral stresses were reduced. On deceleration, the ball of the foot would contact the bumper and the ankle would attempt to evert to the angle of the inclined plane bumper.

However, the modifications in Keppler '387 device may have addressed the problems of bruising of the foot and lateral stresses on the ankle and knee, but the solution failed because it resulted in causing further stress on the ankle and poor body position during exercise. Specifically, the user compensated for the pain, by changing or decreasing the normal hip height to decrease the angle to which the ankle must evert after impact with the steep ramp of the bumper. This altered the position of the user's leg and body which decreased the effectiveness of the exercise and led to other injuries to the user.

Another problem with conventional slide boards is that the bumpers are parallel to each other at the ends of the plastic sheet, which limit the user's motion to lateral side-to-side motions in one direction, along with limiting the use to a singular-use design specific for speed skating training. Specifically, these conventional slide boards fail to provide an adjustable toe-out angle or optimum toe-out angles for the motions of specific other exercises, which substantially limits their use. The reason is the foot tends to naturally turn outward slightly as the user pushes off the bumper, the bumpers should be designed to be toed out slightly to allow the user to push off comfortably and remain aligned upon the slide board.

The present disclosure solved some of the conventional slide board structural configuration problems, by addressing structural configuration issues that caused injuries to users and overcame the limited utility by expanding the types of training activities along with the types of exercises, and addressed some of the technological needs of today's sports exercising industries and other related exercising technology industries.

SUMMARY

The present disclosure relates to slide boards, and more particularly to slide board components that in combination, allow a user to simulate a body dynamic of a naturally occurring posture and motion of a human's body optimized for performing the motion that corresponds to a user-selected path of motion, or a straight line path of motion, that minimizes or eliminates injuries during use, and expands the utility by providing different training activities and types of exercises.

An embodiment of the present disclosure includes an exercise apparatus including a board with a front, a back, and a top sliding surface from first and second opposing side ends. Bumpers with shock-absorbing systems adjustably attached to locations on the top sliding surface on the first and the second opposing side ends that include a variable length between the bumpers and variable push-off angles. A counterforce and guiding system that provides an amount of counterbalancing force corresponding to an amount of force by an amount of a user lean force during a sliding motion between one bumper to an opposing bumper on the top sliding surface. While simultaneously providing an amount of a guiding force from at least one harness worn by the user that is not affixed statically, to allow a user's motion to freely glide on a path of motion of the guideline and guided with an amount of force to overcome an amount of a user motion to correspond to a user-selected path of motion on the top sliding surface as the user slides between the one bumper to the opposing bumper. Wherein the combination of the adjustability of the bumpers and effects of the guiding forces from the counterforce and guiding system result in the user simulating a body dynamic of a naturally occurring posture and motion of a human's body optimized for performing an optimized path of motion that corresponds to a user-selected path of motion while preventing the user from traveling off the board resulting in an injury.

The user-selected path of motion determines how to adjust the components of the slide board, including each bumper location on the top sliding surface, a variable length between the bumpers, and each bumper's variable push-off angle, based on a user's characteristics and a user-selected simulated training exercise. The user provides their specific characteristics and the simulated training exercise to perform for the workout session and then makes the necessary adjustments to the components of the slide board. For example, some user characteristics may include height, weight, leg dimensions, etc. Some simulated training exercises the user can choose from ice-skating, figure skating, speed skating, downhill skiing, skate-skiing, cross-country skiing, cross-country skiing, rollerblading, and cross-training fitness activities. Further each training activity corresponds to a type of training activity in a workout session, some types of training activities include, one or a combination of: a foundational training that includes, one or more of, a flexibility training, a mobility training, a core training, or a balance training; a strength training that includes a resistance training; a metabolic training that includes an aerobic energy system training, an anaerobic energy system training, or both; and one or a combination of a speed, a agility, or a quickness training.

When making adjustments to components of the slide board, for example, the bumpers, each bumper includes an adjustable base plate connectable to locations on the top sliding surface such that altering an orientation of each bumper adjustable base plate locations on the top sliding surface, changes an amount of the variable length between the bumpers and the variable push-off angles, resulting in changing a user's stride mechanics or a stride angle of the user on the top sliding surface. Wherein a change of the user's stride mechanics or the stride angle of the user on the top sliding surface, results in the user simulating a change in the amount of a user's body energy to perform one or more physical fitness training activities, a change in amount of energy to one or more lower extremity muscle groups to perform one or more physical fitness activity, or a change in amount of energy to a portion of one or more lower extremity muscle groups, or both, to perform one or more physical fitness activity, For example, changing the variable push-off angles of the bumpers, where one bumper variable push-off angle is not parallel to another bumper variable push-off angle, results in the user bumper push-off being at a non-parallel angle. Simultaneously, the guiding force guides the user into a position on the top sliding surface according to the user-selected path of motion, to a guided position allowing the user's other foot to impact the other opposing bumper on the top sliding surface.

Another aspect of understanding this concept is that each bumper includes an adjustable base plate connectable to locations on the top sliding surface, such that altering an orientation of each bumper adjustable base plate locations along a long axis in a direction from the first and the second opposing side ends of the board, and along a short axis from the front to the back of the board, or both, changes one of a variable length between the bumpers, variable push-off angles, or both.

Each bumper includes an adjustable base plate attachable at locations on the top sliding surface and connected to an end of a shock-absorbing system, another end of the shock-absorbing system extends to a foot contact bumper. During the slide board testing phase, it was observed that when the foot contact bumper push-off angle was set to a given angle, the foot of the test user pushed off at the same given angle, propelling the test user along the top sliding surface at the same given angle. This observance was significant because it was later realized that a user's anatomy can be accommodated based on an adjustability of the position of the bumpers, or more specifically the adjustment of the push-off angle in combination with the length between the two bumpers. In particular, each user has a naturally unique anatomical degree of alignment of their feet and ankles in relation to their knees, hips, and hindfoot mobility that will dictate the most efficient foot position for push-off during this training regimen. The ability to adjust the angle of the bumper position allows different users to individually select the foot position by which they will be pushing off and accelerating. This allows for a more natural foot position for each user. This is in direct contrast to conventional slide boards that do not allow for this type of selection regarding the angled foot position or adjustability. This means, that each, and every user when using the conventional slide boards, would be forced to utilize the predetermined and non-adjustable push-off position.

The embodiments of the present disclosure include this adjustability to allow for more efficiency and effectiveness of a training program. Equally important is that this adjustability will individually optimize push-off positioning for each user which will help reduce the likelihood of repetitive overuse injuries which may occur when the lower extremity is not free to adopt the position of most anatomic comfort. Another realization is that this adjustability overcomes the conventional slide board structural configurations, by aligning each user naturally unique anatomical degree of alignment of their feet and ankles in relation to their knees, and hips, to maximize the energy in the ankle and knees to increase the user's energy in delivering improved performance.

In addition, the angled foot contact bumper positions and the adjustability of such angled foot contact bumper positions allow the user to perform different modes of training. For example, by selecting a particular angle for the foot contact bumper, the user will be strengthening a targeted group of muscles or portions of the muscles in a group of the musculature of the lower extremity, including the lower leg, the thigh, musculature, and hip musculature. Thus, each user can select different workouts with different foot contact bumper positions to vary the nature of the training regimen for each training activity. Some benefits include significantly improving the effectiveness of each training activity, and additionally helping reduce the likelihood of repetitive injury since each different foot contact bumper position will stress the joints and muscles at slightly different amounts and reduces the overuse phenomenon.

During the slide board testing phase, it was realized that all the test users' feet tended to naturally turn outward slightly as each test user pushed off the foot contact bumper. At least one aspect of innovation obtained from testing was that a slider's motion of their foot push-off and impact angles when contacting bumpers could benefit from using variable push-off angles that can simulate a more natural motion of a human body by further controlling these forces against the human foot which would change depending on a desired speed or intensity or personal skating technique of the skating maneuver. Additionally, the importance of this realization became apparent and satisfied today's slide board athletes' demand for biomechanical slide board configurations, increased training versatility, and performance-based muscular training within the slide board competitive marketplace.

Another observation regarding conventional slide boards was that due to the foot contact bumpers being in a parallel position to each other, there was no adjustable toe-out angle or optimum toe-out angles for the motions of many training exercises, which substantially limited their use. The Keppler conventional slide boards taught conventional slide boards use could result in users experiencing bad impact pressures and stresses on their feet, ankles, and knees. Specifically, impact on the fifth metatarsal of the foot contacted the rigid vertical wall of the bumper, where there was an initial impact caused by bruising of the side of the foot, which eventually led to lateral pressure on the subtalar joint and the knee, stressing the lateral collateral ligament, along with other injuries such as damage to the user's joints. Thus, there is a commercial need to develop a slide board that can overcome these types of injuries and provide a solution for humans with anatomical alignment issues to use slide boards. Accordingly, the embodiments of the present disclosure meet this commercial need by aligning each user naturally unique anatomical degree of alignment of their feet and ankles in relation to their knees, and hips, to maximize the energy in the ankles and knees to increase the user's energy in delivering improved performance, while also minimizing the likelihood of injuries.

Another realization gained during the slide board testing phase was adjusting the foot contact bumpers at angles of a user's foot in a range from 0 degrees to 45 degrees, and from 0 to 55 degrees, from a line that approximates the direction of travel by the user. Similarly, the push-off angle in a range between 0 to 45 degrees offset from a line perpendicular to a line connecting the right and left feet of the skater, if the skater was standing erect with their feet symmetrically placed on the slide board. It is known that at least one goal of propelling oneself during a sporting activity was that the athletes generally want to move forward. However, conventional slide boards do not allow forward motion and are restricted to only lateral motion, side to side. Due to the structural configuration of conventional slide boards a user cannot propel himself or herself forward with any degree of a forward vector user cannot or is not allowed a "bodily lean" (either a forward bodily lean or a backward bodily lean) which is contrary to a normally and naturally occurring motion while true ice-skating or other athletic activities such as rollerblading, skate-skiing, cross-country skiing, etc. Conventional slide board structures require the user to be in an erect standing position during use with the center of gravity not in a forward position/location, and if attempted to lean in either a forward or a backward direction, is likely to fall and risk injury.

While observing the test user's skating propulsion, the realization gained was that not only does the test user push off at angles that vary between 0 to 45 degrees (observed were angles from 0 to 55 degrees), but the test users also leaned forward during propulsion (or backward, in the example of the backward ice-skating technique). The forward lean places the body's center of gravity slightly in front of themed-coronal plane of the body. Analysis of expert opinion and research shows that the most efficient body lean position for athletes during power skating in ice hockey is 45° to 52°, and 65° to 80° body lean during speedskating, and 10° to 30° body lean during Nordic cross country skate skiing.

These observations led to the development of a counterforce and guiding system, that provides an amount of counterbalancing force corresponding to an amount of force by an amount of a user lean force during a sliding motion between one bumper to an opposing bumper on the top sliding surface. While simultaneously providing an amount of a guiding force from at least one harness worn by the user that is not affixed statically, to allow a user's motion to freely glide on a path of motion of the guideline and guided with an amount of force to overcome an amount of a user motion to correspond to a user-selected path of motion on the top sliding surface as the user slides between the one bumper to the opposing bumper. Wherein the combination of the adjustability of the bumpers and effects of the guiding forces from the counterforce and guiding system result in the user simulating a body dynamic of a naturally occurring posture and motion of a human's body optimized for performing an optimized path of motion that corresponds to a user-selected path of motion while preventing the user from traveling off the board resulting in an injury.

We quickly realized the significant importance of these innovative findings because they solved and overcame many of the shortcomings of the conventional slide board exercise apparatus. The embodiments of the present disclosure combination of innovations work together to provide a most realistic training regimen when trying to simulate activities such as skating or cross-country skiing or skate skiing or downhill skiing or speedskating, etc. Mechanical and observational studies clearly show that the proper bodily mechanics of these activities include the natural athletic posture which involves a forward lean during propulsion activities and demonstrates the importance of proper lower extremity position when trying to maximize the effect of training modalities. This includes proper stride and foot position. The instruction and coaching in such fields, such as speedskating and ice hockey and skate skiing focus on specific mechanical factors to maximize effectiveness of workouts and efficiency of the athletic activity. These coaching standards include a strict focus on proper foot position during push off. This present disclosure provides for individualized adjustments of the slide board components to achieve these goals. The conventional slide board structural configurations had many limitations that could not be addressed by their designs. For example, the conventional slide boards do not have any counterbalance or guidance system to allow for the athletic posture forward lean; this greatly limits the effectiveness of the training on these conventional slide boards. In addition, the conventional slide board foot angle push off cannot be adjusted by the individual user and therefore their respective available training regimens are very limited.

The orthopedic and sports medicine literature clearly outlines the causes of overuse injuries. These may occur from an athlete performing the same exact motion thousands of times, resulting in an overuse musculoskeletal injury. But if adjustments can be made to the workout, to change or provide variations, then these overuse injuries are much less likely to occur. Embodiments of the present disclosure allow for multiple alterations and adjustments, including the slope of the board, the angle of the foot push off, the length of the stride, across the board, and the ability to lean forward in an athletic position. In addition, the orthopedic literature demonstrates that joints and muscles are more likely to be injured during training activities if there are rigid constraints to the anatomy of the athlete during training. The embodiments of the present disclosure provide for a free floating and shock absorbing bumper, which allows for small but vital accommodations of different anatomy during foot strike phase and during the push off phase of the exercise. These minor angular accommodations eliminate the concept of anatomical constraint during the activity. The conventional slide board involves non-accommodating rigid or semi rigid bumpers which constrain the user's foot to one specific foot position. These conventional slide boards can be very detrimental to the foot and ankle and knee and hip joints and are more likely to result in an overuse injury. In addition to providing accommodation to the foot position during foot strike, the non-constrained and shock absorbing bumpers also help reduce musculoskeletal injury by absorbing the striking force during the repetitive activity. This makes the training activity on this new apparatus a low impact activity. The foot strike on conventional boards, which occurred against rigid bumpers, was, by definition, a high impact training activity. The orthopedic literature clearly demonstrates that high impact repetitive training activities, such as those performed on conventional slideboards, are much more likely to result in overuse-type musculoskeletal injuries than exercises that are performed with a low impact technique. The shock absorbing bumpers in this new apparatus provide for a low impact training system.

Another embodiment of the present disclosure includes training activities having individual adjustments for each adjustable component of the exercise apparatus that is a non-repeating combination. This means that of the multi-variations of all the combinations of adjustments to the components of the exercise apparatus, each training activity has a different combination of adjustments of components for the exercise machine when compared to any other training activity's combination of adjustments for the exercise machine. This means that no training activity is like any other training activity's combination of adjustments to the components of the exercise machine.

The adjustable components of the exercise apparatus include a board with a front, a back, and a top sliding surface formed from first and second opposing side ends. Bumpers with shock-absorbing systems are adjustably attached to locations on the top sliding surface on the first and the second opposing side ends that include a variable length between the bumpers and variable push-off angles.

A counterforce and guiding system provides an amount of counterbalancing force corresponding to an amount of force by an amount of a user lean force during a sliding motion between one bumper to an opposing bumper on the top sliding surface. While simultaneously providing an amount of a guiding force from at least one harness worn by the user that is not affixed statically, to allow a user's motion to freely glide on a path of motion of the guideline and guided with an amount of force to overcome an amount of a user motion to correspond to a user-selected path of motion on the top sliding surface as the user slides between the one bumper to the opposing bumper. Wherein the combination of the adjustability of the bumpers and effects of the guiding forces from the counterforce and guiding system result in the user simulating a body dynamic of a naturally occurring posture and motion of a human's body optimized for performing an optimized path of motion that corresponds to a user-selected path of motion while preventing the user from traveling off the board resulting in an injury.

Each training activity corresponds to an optimized activity strategy plan. For example, each training activity has a non-repeating combination of individual adjustments for each adjustable component of the exercise apparatus based on a biomechanical optimization for the user (i.e., characteristics of the user, a type of training activity such as hockey skating, and a type of exercise such as a high level of intensity), so when the user is using the exercise apparatus the components of the exercise apparatus are positioned according to the user characteristics as well as the type of training activity and type of exercise for the user to have the best experience for the workout session. Further, the counterforce and guiding system guides the user to perform each training activity with a dynamic balance having a posture and motion, and an amount of bodily lean configured specifically for the user for performing the training activity on the sliding surface, which simulates a body dynamic of a naturally occurring posture and motion of a human's body optimized for performing the training activity.

The optimized activity strategy plan is disclosed as utilizing biomechanics to adjust each component of the adjustable components of the exercise apparatus, however, it is understood that kinesiology principles are also included in determining the optimized activity strategy plan.

Another aspect of the above embodiment is contemplated to have each training activity correspond to one or more type of training activity in a workout session, including; a foundational training having one or more of a flexibility training, a mobility training, a core training, or a balance training; a strength training that includes a resistance training; a metabolic training that includes an aerobic energy system training and an anaerobic energy system training; or a speed, agility, and a quickness training.

Another embodiment of the present disclosure includes an exercise apparatus system including a board with a front, a back, and a top sliding surface from first and second opposing side ends. Bumpers with shock-absorbing systems adjustably attached to locations on the top sliding surface on the first and the second opposing side ends that include a variable length between the bumpers and variable push-off angles, wherein a counterforce and guiding system provides an amount of counterbalancing force corresponding to an amount of force by an amount of a user lean force during a sliding motion between one bumper to an opposing bumper on the top sliding surface. While simultaneously providing an amount of a guiding force from at least one harness worn by the user that is not affixed statically, to allow a user's motion to freely glide on a path of motion of the guideline and guided with an amount of force to overcome an amount of a user motion to correspond to a user-selected path of motion on the top sliding surface as the user slides between the one bumper to the opposing bumper. Wherein the user performs a training activity. Each training activity has individual adjustments for each adjustable component of the exercise apparatus that is a non-repeating combination, when compared to each other training activity combination of adjustments for each adjustable component of the exercise apparatus of the multiple training activities. Each training activity corresponds to an optimized activity strategy plan, where the non-repeating combination of individual adjustments for each adjustable component of the exercise apparatus is based on a biomechanical optimization of the exercise apparatus for each training activity. At least one novelty aspect of the present disclosure is the combination of the adjustability of the bumpers that is specific to the user and user-selected training activity and exercise, in combination with the effects of the guiding forces from the counterforce and guiding system that allow the user simulating a body dynamic of a naturally occurring posture and motion of a human's body optimized for performing an optimized path of motion that corresponds to a user-selected path of motion while preventing the user from traveling off the board resulting in an injury. Further, the optimized activity strategy plan for each training activity utilizes biomechanics to adjust each individual component of the adjustable components of the exercise apparatus and utilizes kinesiology principles to adjust each individual component of adjustable components of the counterforce and guiding system to guide movements of the user according to each training activity.

A method for an exercise machine including adjustably attaching bumpers with shock-absorbing systems on a top sliding surface on first and second opposing side ends of a board, where the bumpers fixed location are at a variable length between the bumpers and variable push-off angles. Determining each bumper's fixed location, each bumper's variable push-off angle, and the variable length between the bumpers based on a user-selected path of motion that is determined from characteristics of a user, and a user-selected training activity and a user-selected exercise. Applying the user-selected path of motion configuration to a counterforce and guiding system to provide an amount of counterbalancing force corresponding to an amount of force by an amount of a user lean force during a sliding motion between one bumper to an opposing bumper on the top sliding surface, that simultaneously provides an amount of a guiding force from at least one harness worn by the user that is not affixed statically, to allow a user's motion to freely glide on a path of motion of the guideline and guided with an amount of force to overcome an amount of a user motion to correspond to the user-selected path of motion on the top sliding surface as the user slides between the one bumper to the opposing bumper. Resulting in the combination of the adjustability of the bumpers and effects of the guiding forces from the counterforce and guiding system resulting in the user simulating a body dynamic of a naturally occurring posture and motion of a human's body optimized for performing an optimized path of motion that corresponds to the user-selected path of motion while preventing the user from traveling off the board resulting in an injury.

Practical Applications

The development of the embodiments of the present disclosure was based upon understanding conventional slide board problems, overcoming them, and incorporating the demands and required modifications of today's sophisticated slide board users and executives working within the sports exercising industries. The embodiments of the present disclosure represent innovative concepts that deliver a multi-exercise slide board that expands the utility, and having each component designed to operate cohesively according to biomechanical principles allowing for an optimized athletic performance experience that prevents injury-related disabilities.

Some practical applications of the embodiments of the present disclosure include the enhanced adjustability of components configured to operate cohesively according to biomechanical principles that offers a solution for humans with anatomical alignment variants of their feet and ankles in relation to their knees, hips, etc. which can prevent them from using conventional slide boards. There is a commercial need for exercise apparatuses to accommodate the humans that have anatomical alignment variants of their feet and ankles in relation to their knees, hips, etc. that can prevent them from using conventional slide boards. Forty-five percent of people have foot problems due to anatomical alignment variants of their feet and ankles in relation to their knees, hips, etc. which can prevent them from using conventional slide boards due to causing them pain such as burning heel pain when walking, or when exercising feel pain due to their knee, hip, or back that eventually prevents them from continuing.

The embodiments of the present disclosure address the needs of a large group of people that are visually impaired athletes, including the Olympic Blind athletes competing in the World Paralympic Games, including cross-country. The exercise apparatus solves a commercial need for visually impaired athletes by allowing them to train and not have to be assisted by an assistant who guides them. The exercise apparatus provides the opportunity to allow these athletes to train when and where they prefer without the assistance of a guide. Presently, a blind athlete who wants to train for Nordic cross country skate skiing would need to do so outdoors with a companion. This training apparatus, which very closely simulates skate skiing training techniques, would allow the individual to train indoors, independently, without a companion.

The embodiments of the present disclosure address the needs of a large group of people suffering anatomical alignment variants of their feet and ankles in relation to their knees, hips, etc. with a customizable exercise apparatus with components that can be adjusted to overcome the individual's alignment variants of their feet and ankles in relation to their knees, hips, etc. When your feet are misaligned the ankle bone can slip off the heel bone, falling forward and out of line, causing the sinus tarsi (the naturally occurring space just below your ankle joint) to collapse and your feet overly roll inward. The average person takes between 5,000 and 10,000 steps a day, where the alignment variants of their feet and ankles in relation to their knees, hips, etc. can get worse with excessive or continued exercise. When a person stands on their feet that may be misaligned and can cause a chain reaction of misalignment throughout your body. Where a human's body can end up being forced to compensate by putting excessive strain on their ankles, knees, hips, and back which may lead to a feeling of chronic pain in any of these areas. Not only does this pain physically hurt your body, but it can also keep you from doing normal activities and enjoying an active lifestyle.

The embodiments of the present disclosure provide enhanced adjustability of components designed to cohesively work together in adjusting the components of the exercise apparatus according to biomechanical principles for a user to use the exercise apparatus. Further, a counterforce and guiding system provides an amount of counterbalance force corresponding to an amount of force by an amount of a user lean, while simultaneously providing an amount of a guiding force from a restraining feature not affixed statically to a user which allows the user to glide along a motion of a fixed guideline. Which guides the user's motion to correspond to a curved arc path or a straight-line path of motion on the top sliding surface as the user slides between the one bumper to the opposing bumper. The combination of the adjustability of the components and effects of the guiding forces result in the user simulating a body dynamic of a naturally occurring posture and motion of a human's body optimized for performing the motion corresponding to the selected motion path.

The skating motion of the present disclosure involves variable push-off angles which can change depending on the desired speed or intensity or personal skating technique of the skating maneuver. These variable angles during skating are in the range of approximately 0 degrees to 45 degrees from the line that approximates the direction of travel of a skater. Said similarly, the push-off angle is between 0 to 45 degrees offset from a line perpendicular to the line connecting the right and left feet of the skater if the skater were standing erect with the feet symmetrically placed on the slide board. The goal of propelling oneself during a sporting activity is generally to move forwards. Thus, the present disclosure embodiments allows for forward propulsion which simulates actual athletic movements. This contrary to the conventional slide board operation, where the user slides on the low-friction surface back and forth between rigid strike bumpers, thereby propelling laterally, back-and-forth in a linear motion, along the longitudinal axis of the board and with no forward directed vector.

Aspects of some of the multi-exercises of the exercise apparatus of the present disclosure include cross-training fitness activities, roller-blading training, skate-skiing training, cross-country skiing training, speed skating, downhill skiing training, and off-ice ice-skating training. Some of the multiple training activities can include one or more lateral movement musculature activities, strength training activities for one or more human body muscles, or rehabilitation activities for one or more human body muscles and joints.

Some types of training activities the user can incorporate into their workout session can include a foundational training workout session directed to, flexibility training, mobility training, core training, and balance training. A strength training workout session for resistance training. A metabolic workout session directed to aerobic energy system training, or anaerobic energy system training. Finally, the user can have a workout session direct to speed, agility, and quickness training.

Further, some types of exercises include, one or a combination of, an amount of intensity or force given by a user to an activity where the amount of intensity is compared to a user's maximum intensity, in the workout session; a total number of times an exercise having a set of movements is repeated within the workout session; a number of workout sessions of an exercise that are completed within a time period; an amount of movement in a joint estimated in an amount of degrees of a motion of the joint, or an amount of movements of multiple joints at a same time ensuring all joints of the multiple joints are being moved in the workout session; an amount of time that is set for each workout session; an amount of speed of an exercise or a number of times a movement pattern is completed within each workout session; an amount of time a muscle or a group of muscles are engaged within each workout session; or an amount of time a user is provided to rest between completing an exercise or a number of times a movement pattern, is completed during each workout session.

Other practical applications the embodiments of the present disclosure provide is that the user can decide on one or more type of exercise for a workout session including: [intensity] an amount of intensity or force given by a user to an activity where the amount of intensity is compared to a user's maximum intensity, in the workout session; [No. of sets] a total number of times an exercise having a set of movements is repeated within the workout session; [Frequency] a number of workout sessions of an exercise are completed within a time period; [Range of Motion] an amount of movement in a joint estimated in an amount of degrees of a motion of the joint, or an amount of movements of multiple joints at a same time ensuring all joints of the multiple joints are being moved in the workout session; [Time] an amount of time for each workout session; [Tempo] an amount of speed of an exercise or a movement pattern is completed within each workout session; [Time Under Tension] an amount of time a muscle or a group of muscles are engaged within each workout session; and [Rest] an amount of time a user is provided to rest between completing an exercise or a movement pattern, during each workout session.

BRIEF DESCRIPTION OF THE DRAWINGS

The presently disclosed embodiments will be further explained with reference to the attached drawings. The drawings shown are not necessarily to scale, with emphasis instead generally being placed upon illustrating the principles of the presently disclosed embodiments.

While the above-identified drawings set forth presently disclosed embodiments, other embodiments are also contemplated, as noted in the discussion. This disclosure presents illustrative embodiments by way of representation and not limitation. Numerous other modifications and embodiments can be devised by those skilled in the art which fall within the scope and spirit of the principles of the presently disclosed embodiments.

DETAILED DESCRIPTION

Figure 1:
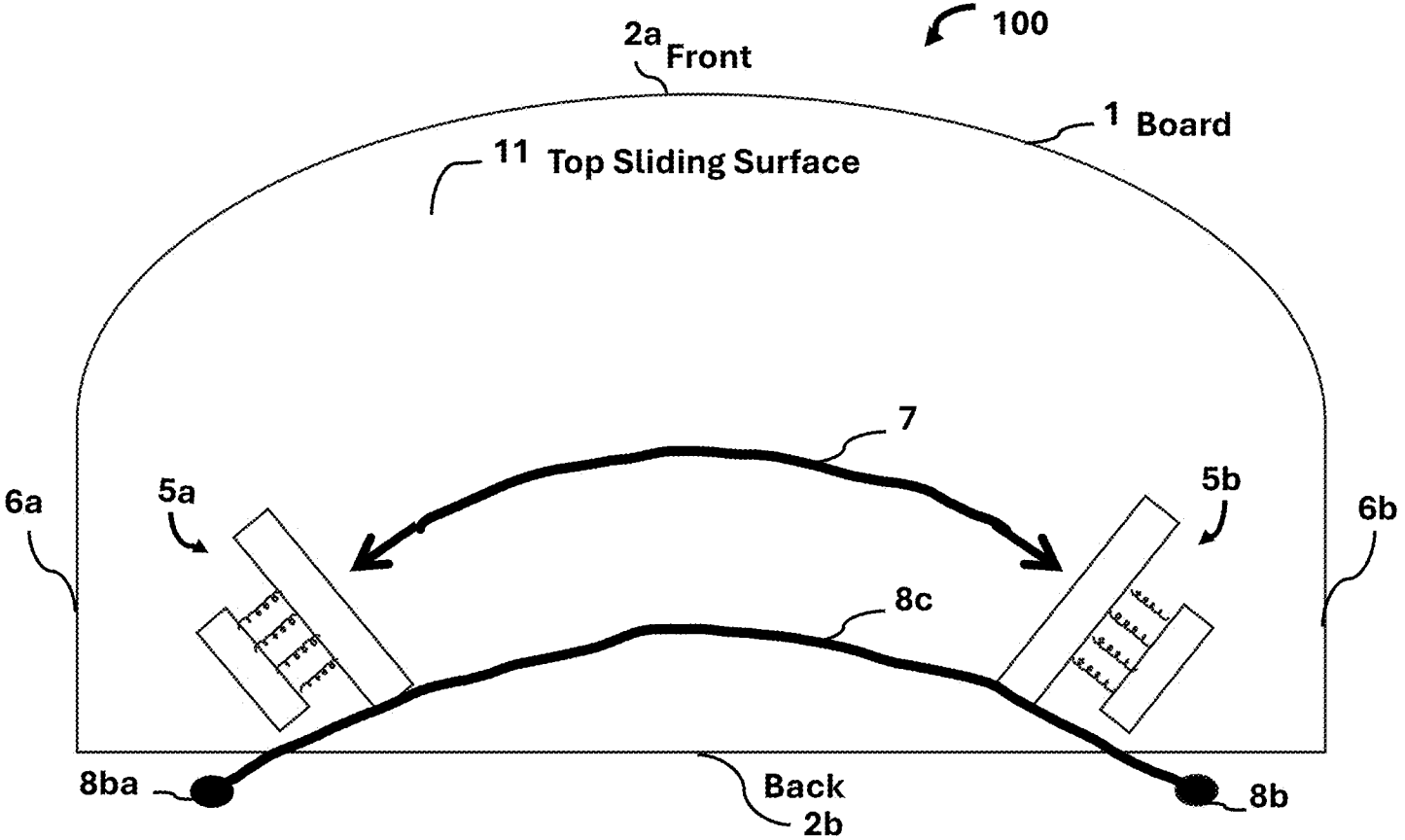
FIG. 1 is a schematic diagram illustrating a top view of an embodiment of a slide board, according to some embodiments of the present disclosure.

FIG. 1 is a schematic diagram illustrating a top view of an embodiment of an exercise apparatus 100, according to an embodiment of the present disclosure. The exercise apparatus 100 includes components including board 1 with a front 2*a*, a back 2*b*, along a length from the front 2*a* to the back 2*b* or short axis (see FIG. 4, #47) of board 1. The front 2*a* to the back 2*b* can have a length of about 42 inches to 48 inches, but it is contemplated this length can be shorter or longer depending on the application. A top sliding surface 11 having adjustable bumpers 5*a*, 5*b* formed from first 6*a* and second 6*b* opposing side ends, or long axis (see FIG. 4, #40) of board 1. The first side 6*a* to the second side 6*b* of the board can have a length of about 60 inches to over 100 inches, ideally, the length can be about 80 inches to 88 inches, or about 84 inches. The board could have many different types of shapes, for example, rectangular, round, oblong, etc. Aspects of the board could be considered a low-friction surface as the top sliding surface as disclosed herein. The low friction could be placed on a hard surface such as wood, cement, etc. The low-friction surface may be ice, simulated ice, or any material or combination of materials associated with the top sliding surface as disclosed herein. The board may be termed a low-friction top surface member, top sliding surface member, etc.

Another component includes the user-selected path of motion 7 when the user is sliding back and forth from the opposing bumpers 5*a*, 5*b*. Of course, the user may also provide a straight line of travel if desired. A counterforce and guiding system includes guideline 8*c* that may be fixed to locations on end 8*a* and another end 8*b* of guideline 8*c*. Contemplated is that the ends 8*a*, 8*b* can be fixed at many different locations including above board 1, to either side 6*a*, 6*b*, of board 1, or positioned or structured in many ways, either moveable or stationary, the structural configuration only depends if operates as the counterforce and guiding system can operate as intended.

Still referring to FIG. 1, the guideline can include a metal rail, a segmented metal rail, one or more segments of material, and the like, wherein the type of material or combination of material and structure depends only if operates as the guideline's intended purpose as disclosed herein.

The harness can be a single harness worn around the waist of the user, an upper chest harness, or a combination of the upper chest harness with the waist-worn harness, all of which depend upon the structure and design of the counterforce and guiding system. Further, the harness may be termed as an apparatus, member, or system, such as a restraining apparatus, a safety apparatus, etc.

Still referring to FIG. 1, the location, structure, and configuration of the counterforce and guiding system are contemplated to be mobile or stationary, have positions at one of, above board 1, along either side 6*a*, 6*b*, or some combination thereof, along different configured structures, all of which depend upon if the intended guiding forces are met as disclosed.

The user of the slide board slides back and forth wearing socks, stockings, or the like, on their feet or may use athletic shoes covered with a low-friction material such as nylon to slide from one bumper to the opposing bumper.

Figure 2:
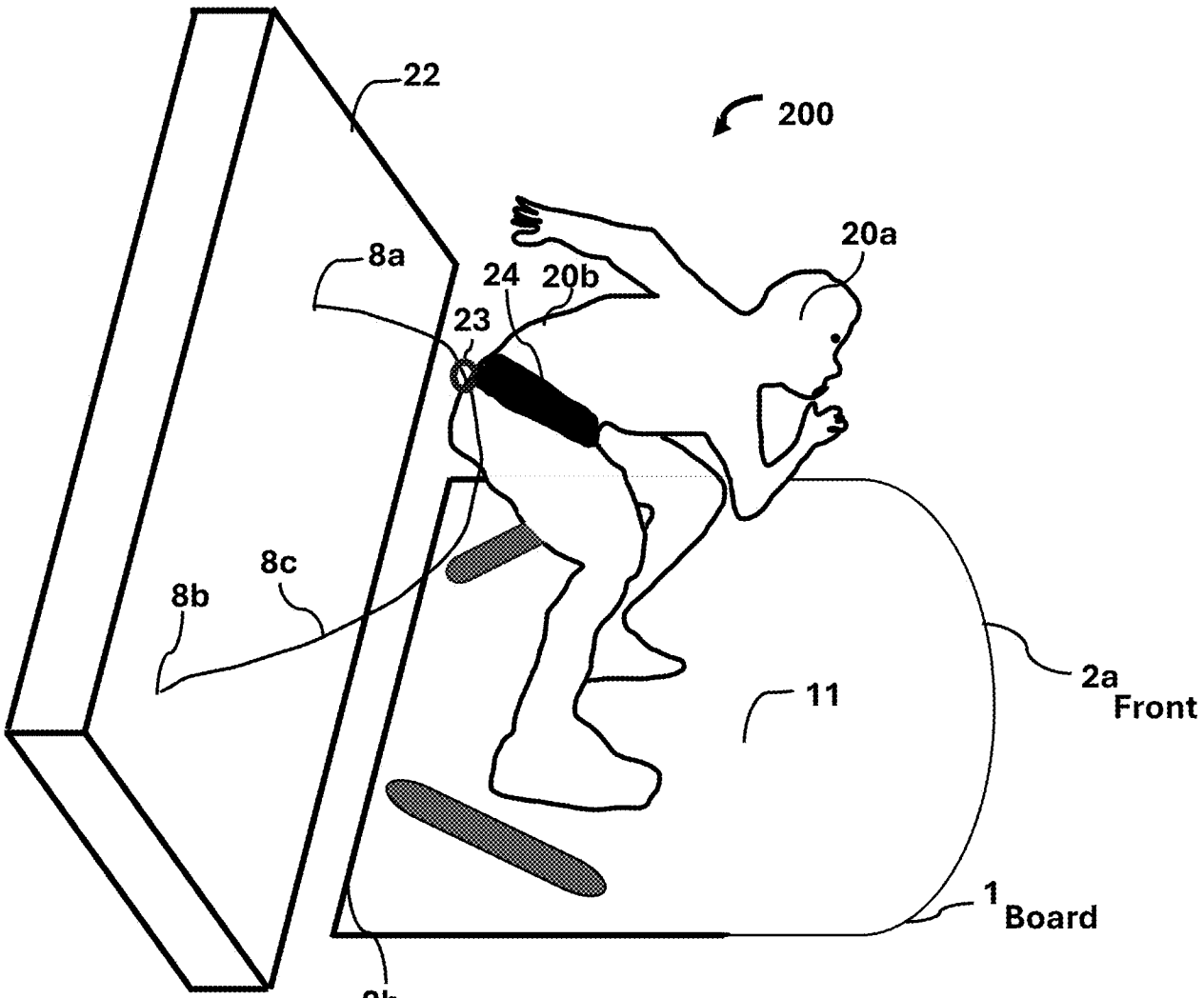
FIG. 2 is a schematic illustrating a field of view of the exercise apparatus of FIG. 1, to that of an extent of an observable perspective at a given moment, according to some embodiments of the present disclosure.

FIG. 2 is a schematic illustrating a field of view of the exercise apparatus of FIG. 1, to that of an extent of an observable perspective at a given moment, according to some embodiments of the present disclosure. The exercise apparatus 200 includes the counterforce and guiding system components including a guideline 8*c* having fixe ends 8*a*, 8*b*, a harness 24 fitted to a waist of a user 20*a*, one or more pulley or ring like device 23 attached to the harness 24 and positioned on approximate a back 20*b* of the user 20*a* to operate behind the user 20*a*.

The harness 24 worn by user 20*a* at the user's waist, is attached to one or more pulley or a ring-like device 23*b*, while the user 20*a* is on the top sliding surface 11 of board 1 facing toward the front 2*a* of board 1. The user 20*a* can slide across the top sliding surface 11 while guided by guideline 8*c* which provides a guiding effect to guide the user on a user-selected path of motion.

Referring to FIG. 1 and FIG. 2, the counterforce and guiding system includes guideline 8*c* positioned beyond the back 2*b* of board 1, attached to fixed locations 8*a*, 8*b* on a back wall 22. This structural configuration provides an amount of counterbalance force corresponding to an amount of force by an amount of a user lean generated during a sliding motion between one bumper to an opposing bumper on the top sliding surface 11 by a type of user-selected training activity and a type of user-selected exercise. Specifically, this configuration simultaneously provides an amount of a guiding force from ring 23 that is not affixed statically to the harness 24 which allows the user 20*a* to freely glide along the guideline's 8*c* arc path that corresponds to the user-selected path of motion 7 of FIG. 1 when sliding back and forth from the opposing bumpers 5*a*, 5*b* of FIG. 1. Again, the user can also travel in a straight line of motion travel path when sliding back and forth from the opposing bumpers 5*a*, 5*b* of FIG. 1, if so desired.

Still referring to FIG. 1 and FIG. 2, the user-selected path of motion changes according to the characteristics of the user (i.e., height, weight, body dimensions of stride to leg length, and other aspects), and the user-selected training activity and user-selected exercise. At least one uniqueness of the exercise apparatus is creating the user-selected path of motion 7 of FIG. 1 that is specific to each user's characteristics in combination with the user-selected training activity and exercise, automatically provides a corresponding amount of counterforce mechanism against an amount of user lean generated from the type of user-selected training activity and exercise performing the sliding motion between one bumper and an opposing bumper, to deliver a user experience simulating, a body dynamic of a naturally occurring posture and motion of a human's body optimized for performing the type of activity according to the type of exercise, (for example, an athletic position assumed by an ice skater (a type of activity) performed at an amount of intensity (a type of exercise) chosen by the user).

Each training activity performed by a specific type of exercise creates an amount of user leaning force that the system automatically responds with an amount of inherent mechanical effect by the guiding force to guide the user to a desired curved arc or straight line of motion on the top sliding surface as the user slides on the slide board between one bumper to the opposing bumper.

Specifically, at least one uniqueness of the exercise apparatus is the adjustability of the components to each user's characteristics along with the user-selected training activity and user-selected exercise, that results in the exercise components to cohesively abide by a user's biomechanical principles in combination with the counterforce and guiding system that automatically provides an amount of counterbalance force to an amount of force by an amount of a user lean generated while performing each training activity and a type of training exercise while sliding between one bumper to an opposing bumper on the top sliding surface 11 during each workout session.

Still referring to FIG. 1 and FIG. 2, the counterforce and guiding system simultaneously provide an amount of a guiding force from the ring 23*b* that is not affixed statically to the user 20*a* which allows the user 20*a* to freely glide along the guideline's 8*c* arc path that corresponds to the user-selected path of motion 7 of FIG. 1 when sliding back and forth from the opposing bumpers 5*a*, 5*b* of FIG. 1. Of course, the user can choose a training activity that allows the user to travel in a straight-line motion travel path when sliding back and forth from the opposing bumpers 5*a*, 5*b*.

The structure of guideline 8*c* is configured to the characteristics of the user (i.e., a height, a length, weight, etc.) in combination with the user-selected training activity and exercise according to the user-selected path of motion, to guide the user along the guideline path of motion that corresponds to the user-selected path of motion when sliding back and forth from the opposing bumpers 5*a*, 5*b*. This combination of features allow the user to lean "forwards" (or, in other forms of usage of the apparatus, "backwards") during the use of the slide board, to improve the user's performance by guiding the user to simulate, a body dynamic to that of a naturally occurring posture and motion of the human's body optimized for performing the training activity.

Still referring to FIG. 1 and FIG. 2, wherein this counterforce and guiding system allows the athlete to lean forward during the slide board skating maneuver without falling over forwards (or similarly, leaning backward during the backward skating maneuver or for any person, such as non-skaters, interested in training the muscles that are utilized during this alternative fitness technique). The counterforce and guiding system simultaneously provide an amount of a guiding force from at least one harness worn by the user not affixed statically, allowing a user's motion to freely glide on a path of motion of the guideline and be guided with an amount of force to overcome an amount of a user motion to correspond to a user-selected path of motion on the top sliding surface as the user slides between the one bumper to the opposing bumper.

Thus, by dictating or enforcing the user-selected path of motion, the user is allowed to push off at a non-parallel angle (i.e. the foot strike bumpers (see FIG. 3, #33*a*, 33*b*) are not parallel to each other) from the foot contact bumpers or foot strike bumpers (see FIG. 3, #33*a*, 33*b*) while still returning to the opposing foot strike bumper at the other end of the slide board. Of course, the user can adjust the bumpers to be parallel to, so the user is allowed to push off at a parallel angle from the foot contact bumper and travel in a straight line of motion travel path.

Other aspects of this system allow for the user to perform the training exercise with the "bodily lean" (either forward bodily lean or backwards bodily lean) that normally and naturally occurs during true ice-skating or other athletic activities such as rollerblading, skate-skiing, cross-country skiing, etc. During normal skating propulsion, not only does the athlete push off at angles that can vary between 0 to 45 degrees, but the athlete also is leaning forward during propulsion (or backward, in the example of backward ice-skating technique). The present invention allows forward or backward lean by providing a dynamic tension support using a rope and pulley system, or other similarly functioning embodiments, attached to the athlete's torso near the user's waist.

Guideline 8*c* located beyond the back 2*b* of board 1, is attached to fixed at locations 8*a*, 8*b* on a back wall 22, which can be rope, cord, cable, or any other similar material used to accomplish the intended purpose as disclosed herein. The fixed locations 8*a*, 8*b* on a back wall 22 can be positioned at a height ranging from about thirty inches up to 60 inches, including 36 inches, and at the waist height of the user. The fixed locations 8*a*, 8*b*, can be fixed to any structure or aspect that can withstand the applied guiding force to guide the user. For example, the fixed locations 8*a*, 8*b*, may be fixed to one of; a wall that is stationary, moveable, or telescoping; cylinders that are fixed, moveable, telescoping, or associated aspect to complete the desired purpose of guiding as disclosed. For example, a cylinder configuration could be one cylinder positioned inside of another cylinder, to allow adjustability to one or more fixation points 8*a*, 8*b*, vertically, up and down, to adapt to a user's height, and body motion, or a height that corresponds to an exercise requiring other height demands.

Contemplated is that the guideline fixed points/locations can be attached to a rigid or a semi-rigid fixation points. For example, one fixed point can be behind and to the left of the user, and the other fixed point can be behind to the right of the user. Also, contemplated is the guideline fixed point may consist of a single fixation point, directly behind the user, the other end of the guideline could pass through one or more pulleys and then be fixed at the single fixation point.

Figure 3:
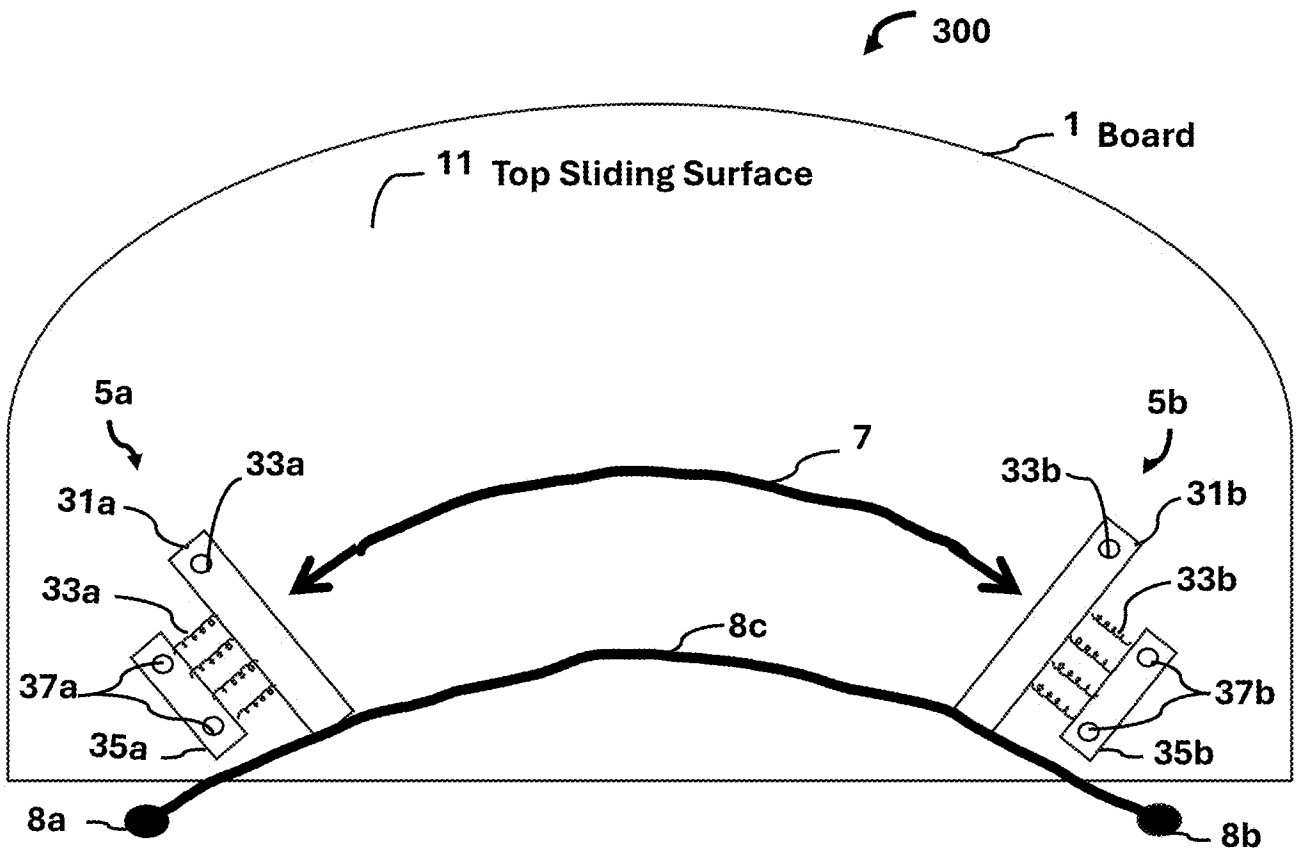
FIG. 3 is a schematic diagram illustrating a top view of the exercise apparatus of FIG. 1, including details of the bumpers, according to some embodiments of the present disclosure.

FIG. 3 is a schematic diagram illustrating a top view of the exercise apparatus of FIG. 1, including details of the bumpers and the bumper shock-absorbing systems, according to some embodiments of the present disclosure. The exercise apparatus 300, illustrates each bumper 5*a*, 5*b* having adjustable base plate 35*a*, 35*b* attachable at locations 33*a*, 33*b* on the top sliding surface 11 connected to an end of a shock-absorbing system, another end of the shock-absorbing system extends to a foot contact bumper 31*a*,31*b*. Wherein a structure of the foot contact bumper 31*a*,31*b* is one of rigid, semi-rigid, or a degree of flexibility based upon characteristics of the user and a user-selected simulated training exercise, that results in the user simulating an enhanced body dynamic of the naturally occurring posture and motion of the human's body optimized for performing the training activity Each bumper 5*a*, 5*b* has an adjustable base plate 35*a*, 35*b* attachable at locations on the top sliding surface and connected to an end of a shock-absorbing system, another end of the shock-absorbing system extends to a foot contact bumper 31*a*, 31*b*. An end of the foot contact bumper is attachable at locations 33*a*, 33*b* on the top sliding surface 11, another end of the foot contact bumper is unattached to the top sliding surface and freely rotates around an attached location 33*a*, 33*b* on the top sliding surface or at its pivot point. The unattached end of the foot contact bumper provides a force-absorbing effect when an amount of foot impact force by a foot of the user impacts the foot contact bumper 31*a*, 31*b*. For example, an impact force of a foot of the user impacts the foot contact bumper 31*a*, 31*b*, along the unattached end while sliding between one bumper to an opposing bumper. The locations of the bumpers 5*a*, 5*b* on the top sliding surface 11 can be associated with the user-selected path of motion 7 with guidance of the guideline 8*c* for allowing optimum user performance of the training activity during the workout session. When altering an orientation location of the attached end 33*a*, 33*b* of the foot contact bumper 31*a*, 31*b* on the top sliding surface 11 allows for adjustments to a length of travel by the user on the top sliding surface 11 between the opposing bumpers 5*a*, 5*b*.

An amount of a forward the lien of a hockey player is approximately in a range of from 45 and 52 degrees, and the forward tilt of an upper body for a speed skater is somewhere in a range of 60 to 80 degrees, from a line associated to a direction of travel of the skater. Depending on the amount of speed, an amount of intensity, or one or more personal skating technique of a skating maneuver, it is possible the above ranges could be less or greater than disclosed. For example, an amount of degrees offset from a line perpendicular to a line connecting a right foot and a left foot, of the user, if the user is in an erect standing position with each right and left foot of the user positioned symmetrically and placed on the top sliding surface, for the user motion to propel in the curved arc path of motion on the top sliding surface as the user slides between the one bumper to the opposing bumper.

Each bumper includes the adjustable base plate 37*a*, 37*b* connectable to locations on the top sliding surface 11 such that altering an orientation of each adjustable base plate locations on the top sliding surface, changes an amount of the variable length between the bumpers 5*a*, 5*b* and the variable push-off angles, resulting in changing a user's stride mechanics or a stride angle of the user on the top sliding surface. Wherein a change of the user's stride mechanics or the stride angle of the user on the top sliding surface 11, results in the user simulating a change in amount of a user's body energy to perform one or more physical fitness training activity, a change in amount of energy to one or more lower extremity muscle groups to perform one or more physical fitness activity, or a change in amount of energy to a portion of one or more lower extremity muscle groups, or both, to perform one or more physical fitness activity.

Still referring to FIG. 3, when the foot contact bumpers 31*a*, 31*b* are not parallel with each other, the user can be guided back to the opposite foot contact bumper at the opposite end of the slide board following the user-selected path of motion due to the guiding of the ring 23 (see FIG. 2, #23) attached to the harness 24 (see FIG. 2, #24) worn by the user 20*a* (see FIG. 2, #20*a*). Of course, the user can arrange the foot contact bumpers 31*a*, 31*b* to be parallel to each other to slide in a straight line of motion travel path, if so desired.

This restraining apparatus also referred to as the counterforce and guiding system, typically has two points of attachment, one to the harness worn at the waist height of the user, and the guideline (at each guideline fixed location are attached adjacent to, or near, one of the opposing bumpers on the slide board, and fixed at points placed approximately 6 feet apart, behind the user).

Still referring to FIG. 3, for example, the fixation points could be rigidly affixed to a wall and immobile wall, or, in a different embodiment, they could be affixed to a bracket that vertically extends up from the slide board itself or a point just adjacent to the slide board. The point of fixation in these latter examples in which the fixation point is not attached to an actual solid wall or other immobile structure, could be a rigid point of fixation on a bracket. Or, in a separate version or embodiment, the fixation points could be attached to a fixation point that is allowed to slide vertically up and down so that the fixation point moves up and down based on the user's height and body position during usage of the slide board. In this latter example, a fixation point could be attached to a cylinder of a certain length, which is rigid or semi-rigid, and this cylinder is situated within a second, longer cylinder with a larger inner diameter. This would allow the fixation point to slide vertically up and down within the larger cylinder. This would accommodate different heights of different users and allow the fixation point to make subtle adjustments in the vertical dimension during the training maneuvers by the user. Contemplated is the counterforce and guiding system that could be a part of a structure that hangs from the ceiling, or any similar like structure that could be moveable or stationary, so as the structure operates as its intended purpose as described herein.

These two fixed points create an arc in the shape using the guideline or restraint cord when the cord is placed in tension, as is the case when the user leans forward while using the slide board. The arc or curved shape of the tensioned restraining cord then dictates a curved or arced path of motion of the user when sliding across the slide board that guides the user along the user-selected path of motion 7 of FIG. 3. This non-straight-line path of travel can only be achieved with the usage of the restraining apparatus as described (i.e., as already mentioned above, the components of the exercise can be arranged for the user to travel in a straight line of motion travel path on the slide board).

Still referring to FIG. 3, the ability to push off at an angle that simulates the true skating maneuver as well as the ability to lean forward (or backwards for the training variation described above) in an athletic forward leaning position (for example, the actual on-ice ice-skating position) is unique to embodiments of the present disclosure. An aspect of the exercise apparatus may include a benefit useful for non-skaters and skaters alike, as users of this apparatus may train different muscles while training at different angles of push off.

Figure 4:
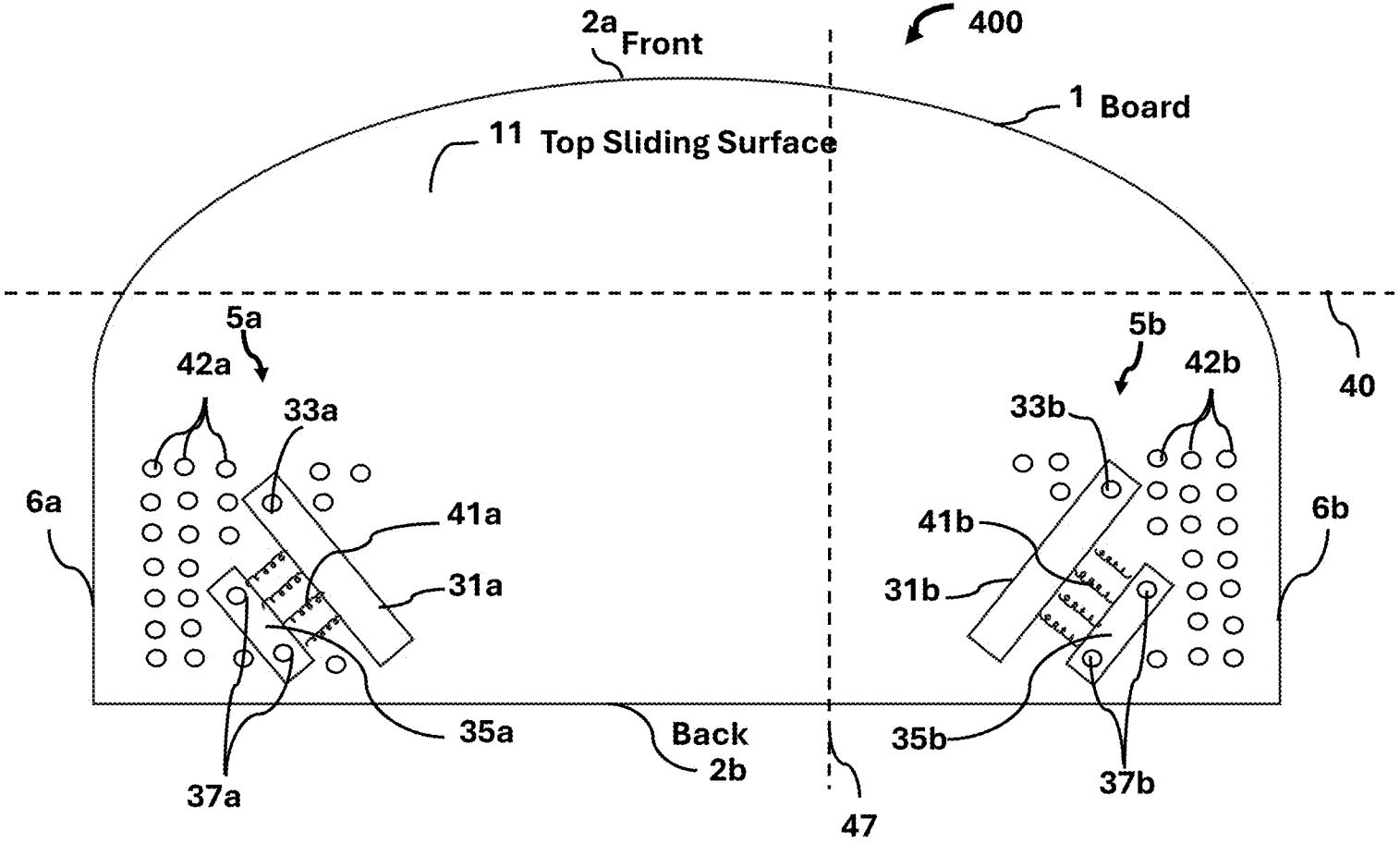
FIG. 4 is a schematic diagram illustrating a top view of the exercise apparatus of FIG. 1, including details of the adjustability of the bumpers on the top sliding surface, according to some embodiments of the present disclosure.

FIG. 4 is a schematic diagram illustrating a top view of the exercise apparatus of FIG. 1, including details of the adjustability of the bumpers on the top sliding surface, according to some embodiments of the present disclosure. Each bumper 5*a*, 5*b* has an adjustable base plate 35*a*, 35*b* attachable at locations 42*a*, 42*b* on the top sliding surface 11 and connected to an end of a shock-absorbing system 41*a*, 41*b*. Another end of the shock-absorbing system extends to a foot contact bumper 31*a*, 31*b*. The end of the foot contact bumper is attachable at locations 33*a*. 33*b*, on the top sliding surface 11 of board 1. Another end of the foot contact bumper 33*a*. 33*b* is unattached to the top sliding surface 11 and freely rotates around an attached location 33*a*, 33*b* of the foot contact bumper on the top sliding surface 11 or at its pivot point (attached locations 33*a*, 33*b* of the foot contact bumper to the top sliding surface). Such that altering an orientation location of the attached end of the foot contact bumper 33*s*, 33*b* on the top sliding surface 11 allows for adjustments to a length of travel for the user on the top sliding surface between the opposing bumpers 5*a*, 5*b*.

A change in the angle of each adjustable base plate 35*a*, 35*b* on the top sliding surface changes the relative angle of the foot contact bumper 31*a*, 31*b* along a long axis 40 in a direction from the first 6*a* and the second 6*b* opposing side ends of the board 1, a short axis 47 from the front 2*a* to the back 2*b* of the board 1, or both, which allows for variations in an angle at which a user's foot impacts the foot contact bumper 31*a*, 31*b*, and further changes an angle of push-off from the foot contact bumper by the user, wherein the push-off angle by the user includes one of, 0 to 15 degrees, 15 to 30 degrees, 30 to 45 degrees, 45 to 52 degrees, or greater than 52 degrees. As mentioned above, altering the orientation of each bumper adjustable base plate on the top sliding surface, allows a push-off of the user to have variable angles and allows for variable lengths of a user's stride mechanics or a stride angle of the user on the top sliding surface to allow for optimum user performance while sliding from one bumper 5*a* to the opposing bumper 5*b*.

Still referring to FIG. 4, the amount of a push-off angle depends on the amount of speed, the amount of intensity, or one or more personal skating technique of a skating maneuver. The amount of the push-off angle can be in a range of 0 to 45 degrees, or at a range set at one of, 0 to 15 degrees, 15 to 30 degrees, 30 to 40 degrees, or 40 to 45 degrees, from a line that is associated to a direction of travel of the user. Specifically, the amount of a push-off angle in the range between 0 to 45 degrees offset from a line perpendicular to a line connecting a right foot and a left foot, of the user, if the user is in an erect standing position with each right and left foot of the user positioned symmetrically and placed on the top sliding surface, for the user motion to propel in the curved arc of motion or a straight line of motion on the top sliding surface as the user slides between the one bumper to the opposing bumper.

The shock-absorbing system 41*a*, 41*b* reduces and dissipates an amount of unwanted forces to one or more parts of a user's body including an ankle, a knee, a hip, a spine, and the foot the user, by providing for a more user's natural length and positioning of a user's foot impacting a foot contact bumper during the user's foot push-off from the foot contact bumper. The foot contact bumper 31*a*, 31*b* can be rigid or semi-rigid, and the shock-absorbing system, or the adjustable tensioning shock-absorbing system, can provide for an amount of push-off force in addition to an amount of push-off force by the user's foot from the foot contact bumper. This results in increasing the amount of force by the user's foot during the user's push-off from the foot contact bumper 31*a*, 31*b* or increases an amount of user energy, that is required to generate an amount of momentum for the user to travel across the curved arc of motion or in a straight line of motion on the top sliding surface as the user slides between the one bumper to the opposing bumper.

Figure 5C:
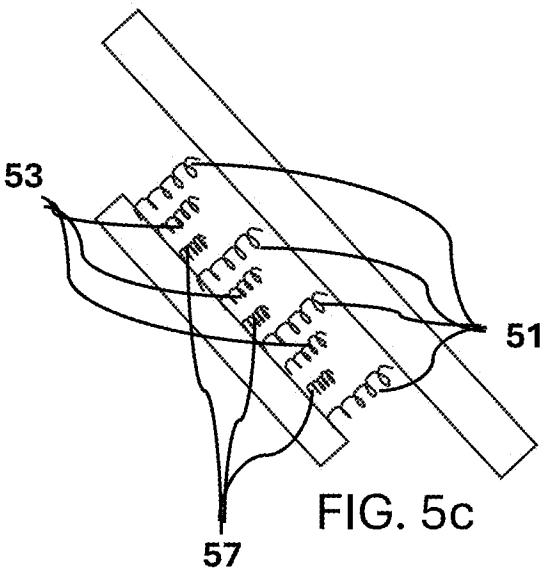
FIG. 5*a*, FIG. 5*b*, and FIG. 5*c* are schematic diagrams illustrating top views of bumpers, including components of the bumpers, according to some embodiments of the present disclosure.
Figure 5A:
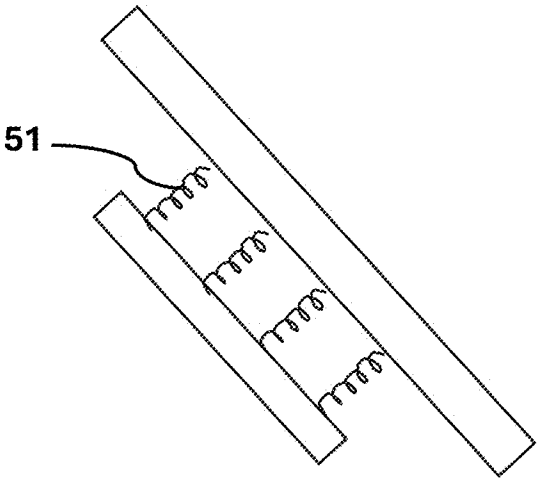
Figure 5B:
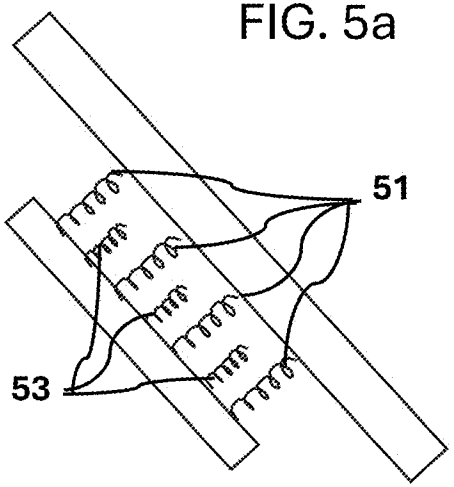

FIG. 5*a*, FIG. 5*b* and FIG. 5*c* are schematic diagrams illustrating top views of bumpers, including shock-absorbing systems, according to some embodiments of the present disclosure. Each bumper has an adjustable base plate connected to a shock-absorbing system 51 that is in communication with a foot contact bumper, wherein an amount of the compression force and an amount of spring force of the shock-absorbing system can affect the degree of an amount of energy the user uses to complete the workout session, as well as add further resistance to maintain a motion of momentum for the user. Wherein the amount of forces of the shock-absorbing system are based upon the characteristics of the user, a user-selected training activity (such as hockey), and a user-selected training exercise (such as an intensity workout) for each workout session, can reduce and dissipate an amount of unwanted forces to one or more parts of a user's body including an ankle, a knee, a hip, a spine, and the foot the user, to prevent an injury upon impact or push-off of a user's foot.

An aspect of the shock-absorbing system is enhancing the amount of force required by the user's foot during the user's push-off from the foot strike bumper. This effectively increases the amount of effort necessary to generate the momentum required for the user to travel across the slide board. This amount of increased effort makes the user's workout more effective in terms of energy required to perform the fitness activity. The adjustable tensioning shock-absorbing system can include detachable compression mechanical devices 51, 53, and 57, each providing a different amount of compression from another. Each detachable compression mechanical devices 51, 53, and 57, can comprise a variable-rate technical spring configuration delivers a varying spring rate over a bumper deflection range. Each detachable compression mechanical device 51, 53, and 57, provides a variable amount of compression different from another. Each detachable elastic device can include one or more at least one elastic material, each providing a variable amount of compression different from another. Further, the amount of user impact force by the user required to compress each detachable compression mechanical device, 51, 53, and 57, is based upon how much each detachable compression mechanical device, 51, 53, and 57, is compressed.

Referring to FIG. 5*a*, FIG. 5*b* and FIG. 5*c*, the configuration of the variable-rate technical spring configuration can have detachable compression mechanical devices, 51, 53 and 57, designed and configured to provide a rate of force that simulates or mimics a natural motion and an amount of a force of human muscles and joints, configured to a limb movement and an amount of a load requirement of the human muscles and joints. This results in simulating human body movements and an amount of force and the amount of load according to the body dynamics of human muscles and joints, which results in optimizing a reduction in the number of injuries to the user. An optimizes the functionality of the exercise apparatus to simulate a realistic body dynamic to that of a naturally occurring posture and motion of the human's body optimized while performing the sliding motion from one bumper to the opposing bumper during the training activity.

For example, each shock-absorbing system includes variable-rate technical springs, the variable-rate technical springs mimic a motion and an amount of force of human muscles and joints and are configured to adjust a spring rate force of the variable-rate technical springs based on a limb movement and an amount of a load requirement of the human muscles and joints, to result in simulated human body movements and an amount of force and an amount of load that human muscles and joints, to optimize a reduction in injuries to the training user, and to optimize the functionality of the exercise apparatus.

The adjustability of the adjustable force(s) of the shock-absorbing system along with the above-mentioned adjustable angling of the base plate (via attachable at locations on the top sliding surface), changes the foot contact bumper user-adjustable bumper push-off angle by the user and allows for variable lengths of a user's stride mechanics or a stride angle of the user. This results in the user simulating one or more physical fitness training activities/exercises for targeting one or more different lower extremity muscle groups, one or more portions of one or more different lower extremity muscle groups, or both. An amount of the compression force and an amount of spring force shock-absorbing system can affect the degree of an amount of energy the user uses to complete the workout session, as well as add further resistance to maintain a motion of momentum for the user, resulting in increasing a level of physical fitness for the user to complete the workout session.

Concerning aspects of non-constrained foot strike, the importance and value of the non-constrained foot strike bumper is supported by multiple compression springs, which is viewed most clearly in the speedskating realm. Speedskating coaching technique mandates that the push-off angle is about 0 degrees with each foot, such that when the speed skater strikes the bumper at about 0° provides the best power during the starting sprint for speedskaters. After researching this with the speedskating coaching community, at least one best embodiment involves the non-constrained foot strike bumper, which is struck at about 0 degrees, by either foot but then during push-off of the foot during forward propulsion, the non-constrained bumper will externally rotate in a range about 0 to 10 degrees as it accommodates to the normal biomechanics of the foot and ankle during this power stride maneuver.

The shock absorbing system can be altered simply by changing the amount of degree of shock absorption. This can be done by swapping out different mechanical devices. For example, a given set of compression springs can be swapped out for a stiffer compression spring(s) or swapped out for less stiff compression spring(s) (see FIG. 6*a* to FIG. 7*c*). Similarly, in the example in which compression springs are used for shock absorption, the number of compression springs could be changed to affect the degree of shock absorption (see FIG. 6*a* to FIG. 7*c*). This would allow different users of different strengths and weights and abilities to adjust the degree of shock absorption that is occurring. Such modularity allows users of different skill levels, body weights, and strengths to personalize the type of workouts. Compression springs represent just one mechanical device option to achieve the desired shock-absorbing effect.

Still referring to FIG. 5*a*, FIG. 5*b* and FIG. 5*c*, an aspect of the shock-absorbing system also enhances the force required to accelerate the foot during the user's push-off from the foot strike bumper. Rather than exerting force against a fixed or minimally flexible foot strike bumper, the shock absorbing system of this invention requires a greater force to achieve the same degree of acceleration or velocity since some of the push off force is transmitted to (or absorbed by) the shock systems themselves (e.g. compression springs and other shock absorbing materials/devices). This feature increases the intensity of the workout; this non-rigid and flexible shock absorbing feature also simulates the normal biomechanics of a foot during actual athletic activities in which an athlete's foot pushes against the surface of the ground or the court or the snow or the ice and is allowed to adjust subtly to surface against which the foot is pushing. During typical athletic maneuvers on a variety of surfaces, there is virtually never a situation in which the participant's foot pushes off against a solid structure that is rigid and immovable. The shock absorbing component simulates this real-world situation.

Another important aspect of the shock absorbing component is that the compressibility of the compression feature can be changed easily (e.g. in the case of compression springs, adding or removing the number of springs or changing the properties of the springs that are attached to the bumper and using springs with varying compressive strengths). The ability to adjust the compressibility allows the slide board users to adjust the intensity of their workouts and allows users of varying ability, strength, weight, height, stride length, etc. to adjust the mechanics of the slide board to fit his or her individual needs and preferences. There could be many different forms of shock absorption as mentioned previously in this document. This could include, but not be limited to, tension springs, compressible fluid devices, visco-elastic materials, foam materials, etc.

For example, the adjustable tensioning shock-absorbing system can include one of, (a) one or more detachable compression mechanical devices each providing a variable amount of compression different from another, (b) one or more detachable variable-rate technical spring devices that deliver a varying spring rate over a bumper deflection range, each providing a variable amount of compression different from another, or (c) one or more detachable elastic devices having at least one elastic material, each providing a variable amount of compression different from another. Wherein an amount of a user impact force by the user required to compress one of, (a) each detachable compression mechanical device, (b) each spring in the detachable variable-rate technical spring device, or (c) each detachable elastic device, is based upon how much, (a) each detachable compression mechanical device, (b) each spring in the detachable variable-rate technical spring device, or (c) each detachable elastic device are compressed.

Figure 6C:
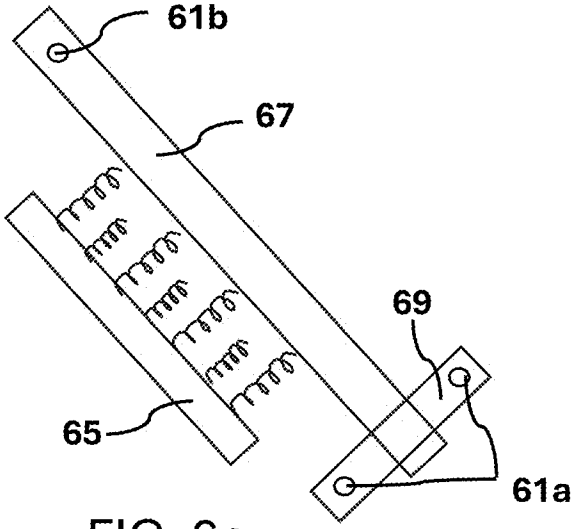
FIG. 6*a*, FIG. 6*b*, and FIG. 6*c* are schematic diagrams illustrating details of adjustable tensioning shock-absorbing system and the foot contact bumpers fixed location on the top sliding surface of the board, according to some embodiments of the present disclosure.
Figure 6A:
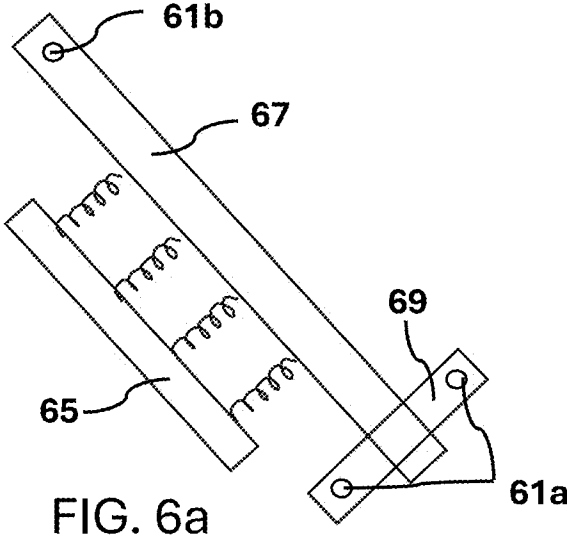
Figure 6B:
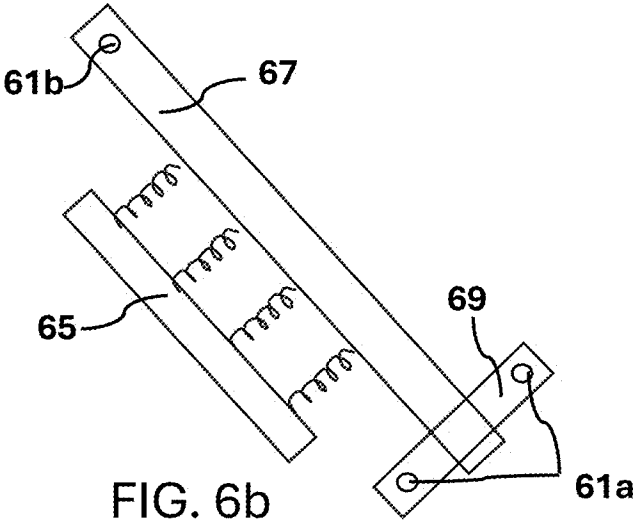

FIG. 6*a*, FIG. 6*b* and FIG. 6*c* are schematic diagrams illustrating details of the adjustable tensioning shock-absorbing system and the foot contact bumpers' fixed location on the top sliding surface of the board, according to some embodiments of the present disclosure. The configuration of the variable-rate technical spring device having the detachable compression mechanical device, 51, 53, and 57, of FIG. 5*a*, FIG. 5*b* and FIG. 5*c*, can be designed and configured with different foot contact bumper 67 fixed configurations 61*a*, 61*b* to the top sliding surface, an operate as intended.

The foot contact bumper structure 67, can be affixed with a cylindrical rigid member that attaches to the foot contact bumper at a location 61*b* placed perpendicular to the top sliding surface of the bumper, at a single point of fixation 61*b* on the foot contact bumper 67 at one end of the foot contact bumper structure. The structural configuration of attaching a single end of the foot contact bumper 67 to the top sliding surface of the board allows for, and necessitates, the foot contact bumper structure to rotate around that rigid cylindrical fixation point 61*a*, in a rotatable pivoting motion, as the user's foot strikes the unattached portion of the foot contact bumper long edge freely rotates as guided by a support member 69 attached at two fixed locations 61*a* on the top sliding surface.

Further, the single-end attachment point 61*b* of foot contact bumper 67 can be adjustable and attached to locations on the top sliding surface according to the location points 42*a*, and 42*b* illustrated in FIG. 4. It is possible, an aspect of fixing the foot contact bumper to the top sliding surface can include permanently using a single cylindrical fixation device (e.g. a 5/16th inch smooth-shanked bolt) to the location 61*a* on the foot contact bumper. Contemplated is that the foot contact bumper can be removably attached to the top sliding surface and re-positioned at other locations on the slide board surface (see locations 42*a*, 42*b* in FIG. 4, as noted earlier). The reason this feature is important is because it allows for adjustments to a length of travel by the user on the top sliding surface between the opposing bumpers.

Still referring to FIG. 6*a*, FIG. 6*b* and FIG. 6*c*, an aspect of the foot contact bumper having a single fixed location on the top sliding surface is the rotation about a single fixed point of rotation which allows for a natural and non-constrained forefoot/hindfoot/ankle position during the foot strike and during the push-off from the bumper itself. This non-constrained component configuration allows for more physiological rotation of the foot and ankle during foot strike and foot push off.

Figure 7A:
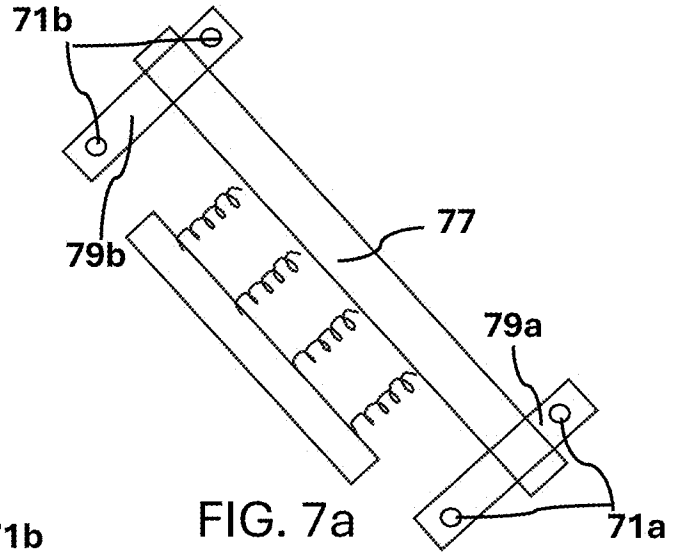
FIG. 7*a*, FIG. 7*b*, and FIG. 7*c* are schematic diagrams illustrating details of adjustable tensioning shock-absorbing system of the foot contact bumpers, and the foot contact bumpers fixed location on the top sliding surface of the board, according to some embodiments of the present disclosure.
Figure 7C:
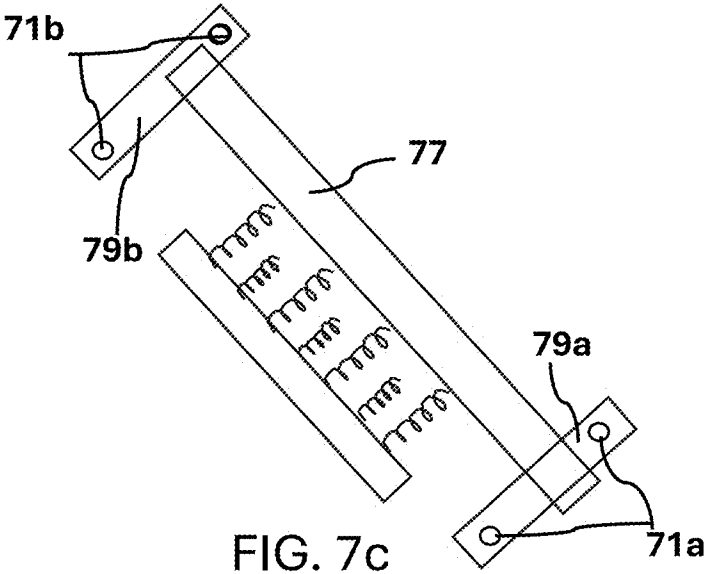
Figure 7B:
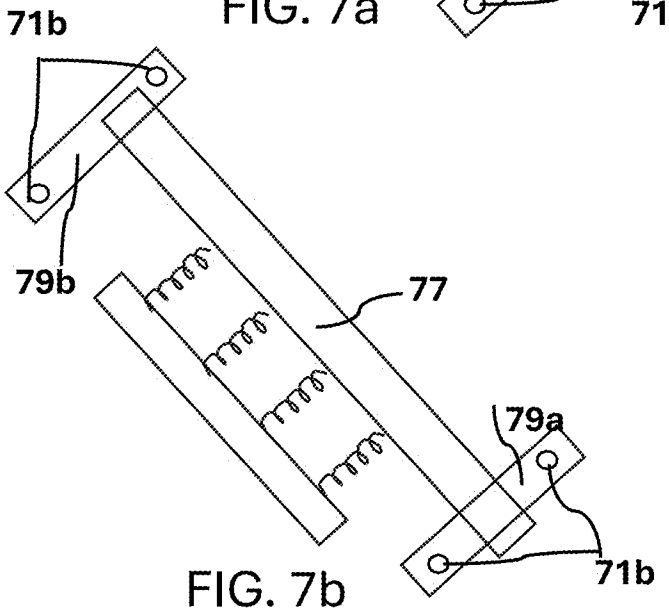

FIG. 7*a*, FIG. 7*b* and FIG. 7*c* are schematic diagrams illustrating details of the adjustable tensioning shock-absorbing system of the foot contact bumpers, and the foot contact bumpers free, according to some embodiments of the present disclosure. The configuration of the variable-rate technical spring device having the detachable compression mechanical device, 51, 53 and 57, FIG. 5*a*, FIG. 5*b* and FIG. 5*c*, can be designed and configured with different foot contact bumper 77 for a free floating and shock absorbing foot contact bumper. The foot contact bumper 77 structure can include a free-floating foot contact bumper 77 while constrained between two support devices 79*a*, 79*b* allowing the foot contact bumper 77 to slide freely symmetrically and in parallel with an impact force of a foot of the user when the user is sliding between one bumper to an opposing bumper. The impact force of the foot of the user contacts the foot contact bumper 77, such that the two support devices 79*a*, 79*b* prevents the foot contact bumper 77 from deflecting, lifting, or moving in an upwards direction, or off of the top sliding surface of the board when the foot contact bumper 77 is impacted by an amount of force by a user's foot. Specifically, since the foot contact bumpers are not rigidly affixed to the board and are free to slide, this configuration prevents the foot contact bumper from deflecting off the surface of the slide board when it is struck with force by the user's foot and prevents the bumper from assuming an unusable position after being struck by the user's foot.

As noted above, each bumper has an adjustable base plate attachable at locations on the top sliding surface and connects to a shock-absorbing system in communication with a foot contact bumper. Specifically, at least one advantage of the free-floating structure of the foot contact bumper 77, is that it allows for a dynamic, individualized accommodation of about 0 to 10-degree adjustable bumper push-off angles for each bumper and improves the user performance and adds to a body dynamic of a naturally occurring posture and motion of the human's body optimized for performing the training activity. This added dynamic, individualized accommodation of about 0 to 10 degrees to the bumper push-off angles for each bumper, can provide humans with an additional level for their alignment variants of their feet and ankles in relation to their knees, hips, etc., and can compensate for the user striking the foot contact bumper outside of the curved arc 7 path or the straight line path of motion, and not cause injury to the foot of the user, but allow the user to continue. The foot contact bumper is free-floating while constrained between two support devices (see FIG. 7A, #71*a*, 71*b*) allowing the foot contact bumper 31*a*,31*b* to slide symmetrically and in parallel, and as mentioned above, provides for a dynamic, individualized accommodation of about 0 to 10-degrees to the user for each foot contact bumper 31*a*,31*b* while providing a force absorbing effect when a foot of the user impacts the foot contact bumper.

Still referring to FIG. 7*a*, FIG. 7*b* and FIG. 7*c*, as mentioned above the adjustability of the angle at which the foot strikes the foot contact bumper can, inherently, change the angle of push-off from the foot contact bumper by the user. For example, the push off angle could be adjusted by the user to 0 degrees or 10 degrees or 20 degrees or 30 degrees, or 40 degrees or any variation therein, by adjusting the angle of the contact base plate. This adjustability of the angle of push-off-by altering the orientation of the respective bumpers-provides for the ability of the user to change the stride mechanics which allows the user to simulate various different forms of physical fitness training exercises (for example, the various stride angles used during different techniques of ice skating) and also allows for the usage of different lower extremity muscle groups and varying portions of those muscles used in the training activity.

At least one other distinctly unique feature and design of the free-floating foot contact bumper, is the ability to change the angles of push-off afforded via the contact base plates (0 degrees or 10 degrees or 20 degrees or 30 degrees, or 40 degrees), in combination with an additional 0 to 10-degree of adjustable bumper push-off angles due to the free-floating for each bumper further improves the user performance and further adds to the body dynamic of a naturally occurring posture and motion of the human's body optimized for performing the training activity. Specifically, the free-floating foot contact bumper 77 while constrained between two support devices 79*a*, 79*b* allows the foot contact bumper 77 to slide freely symmetrically and in parallel with an impact force of a foot of the user when the user is sliding between one bumper to an opposing bumper. Other advantages of having a freely floating foot contact bumper provides advantages to user when adjustable orientation/positioning of the foot strike bumpers on the slide board that allows push-off by the user at variable angles as well as variable lengths of excursion on the surface of the slide board. Still other advantages to the freely floating foot contact bumper are that it enhances the shock-absorbing system effect of reducing and dissipating unwanted forces to the foot and the ankle and the knee and the hip and the spine of the user, due to the additional 0 to 10-degree of adjustable bumper push-off angles. Thus, the shock-absorbing component with the freely floating foot contact bumper also provides for a more natural excursion and positioning of the foot during the foot strike and during the foot push-off from the foot contact bumper.

Still referring to FIG. 7*a*, FIG. 7*b* and FIG. 7*c*, an aspect of having the rotation of the foot contact bumper is that this configuration could also slide linearly and symmetrically traveling in a path parallel to the long axis of the foot contact bumper. In particular, the foot contact bumper slides parallel to the long axis of the foot strike bumper) as opposed to rotating about a fixed, eccentric point. This option would entail the foot contact bumper sliding symmetrically in a direction collinear with the foot strike force. The foot contact bumper would slide into the compression device symmetrically as opposed to eccentrically.

These two options described above could be incorporated into the same slide board system and exist as an option for the user to be used in either embodiment depending upon the user's preference.

Figure 8:
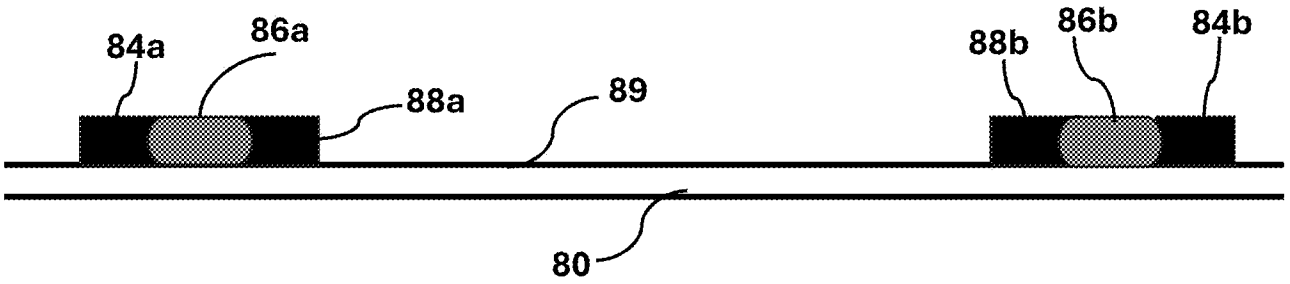
FIG. 8 is schematic diagram illustrating a view of the exercise apparatus along a short axis or from a perspective from a front to a back of the board, according to some embodiments of the present disclosure.

FIG. 8 is schematic diagram illustrating a view of the exercise apparatus along a short axis or from a perspective from a front to a back of the board, according to some embodiments of the present disclosure. The exercise apparatus includes board 80, top sliding surface 89, foot contact bumpers 84*a*, 84*b*, shock-absorbing systems 86*a*, 86*b*, and foot contact bumpers 88*a*, 88*b*.

Figure 9A:
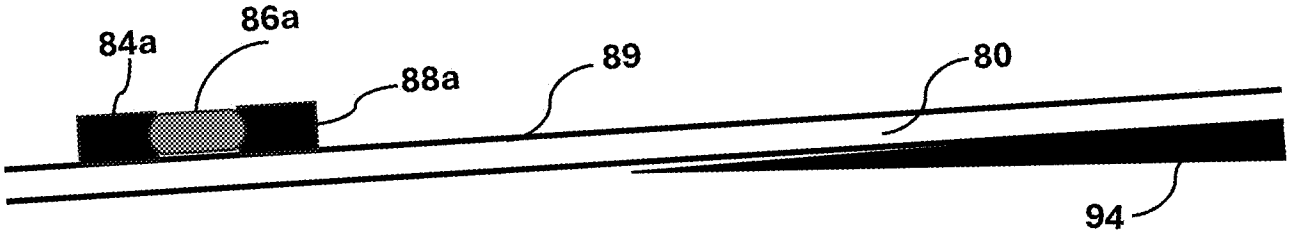
FIG. 9*a* is a schematic diagram illustrating a view of the exercise apparatus along a short axis or from a perspective from a front to a back of the board with the board at an inclined angle, according to some embodiments of the present disclosure.

FIG. 9*a* is a schematic diagram illustrating a view of the exercise apparatus along a short axis or from a perspective from a front to a back of the board with the board position at an inclined angle, according to some embodiments of the present disclosure. Board 80 is elevated by a wedge 94, that positioned the top sliding surface 89 at an incline, along with the foot contact bumper 88*a*, shock-absorbing system 86*a*, and contact base plate 84*a*.

When the top sliding surface 89 is positioned at an inclined slope, (i.e., at a range from 0 to 10 degrees, possibly greater than 10 degrees), the guiding system simultaneously guides an amount of a user-uphill sloped motion to correspond to a portion of a user-selected path of sloped motion that is uphill including when the sloped user pushes off from one of the opposing bumpers to travel uphill to a midpoint of the user-selected path of sloped motion. Then the guiding system simultaneously guides an amount of a user-downhill motion to correspond to a portion of the user-selected path of sloped motion that is downhill from the midpoint of the user-selected sloped of motion including when the sloped user travels downhill to the opposing bumper. All the while during the uphill and downhill user motions, the guiding system continually simulates, a body dynamic of a naturally occurring sloped posture and motion of a human's body on the top sliding inclined slope surface optimized for performing the top sliding inclined slope surface activity.

Some effects experienced by the user on an inclined board, include, first, traveling 'up' the incline during the initial 50% of travel across the board increases the effort required (i.e., going 'uphill' against gravity) to perform the slide board exercise. This allows for more utility and variability in the user's fitness activity and increases the effort required during the exercise routine. Second, the downward slope encountered during the second 50% of the user's travel on the slide board assists in the efficient return of the user towards the opposing foot strike bumper (i.e. by traveling with gravity down the inclination of the board). The user travels on a user-selected path of sloped motion applied specifically by the counterforce and guiding system—and this inclination makes such a non-linear pathway physically easier to achieve.

The restraining feature attached to the user can operate when the board positioned at an inclined position. The restraining feature allows the user to push off from the foot contact bumper going up the incline of the top sliding surface which increases the intensity of the workout for the user. Accordingly, this configuration utilizing the restraining feature is not achievable with conventional slide board devices, because conventional slide boards do not have the restraining feature attached to the user's waist area. The act of sliding up the inclination can only be achieved if the two of the following attributes are included in the slide board design: (1) there are angled foot strike bumpers (i.e. angles greater than 0 degrees to the line that is perpendicular to the line that represents the longitudinal axis of the slide board; and (2) there is a restraining feature that dictates a user-selected path of sloped motion of the slide board user so that the user first travels up the incline and then travels back down the incline on the opposite side of the slide board, both of which are integrated into the embodiments of the present disclosure.

Figure 9B:
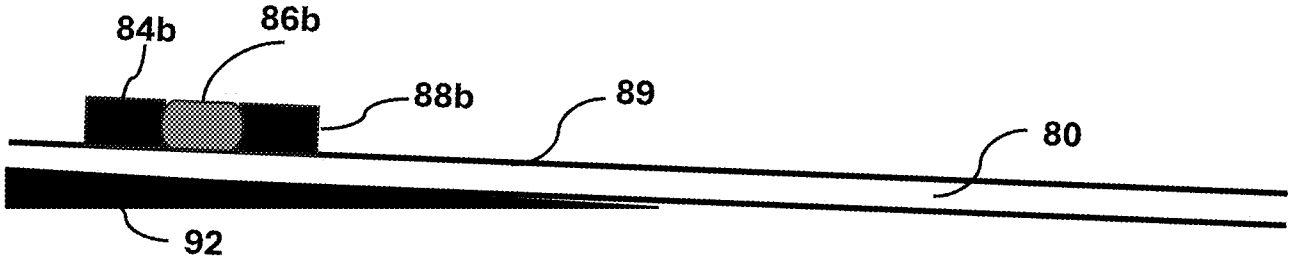
FIG. 9*b* is a schematic diagram illustrating a view of the exercise apparatus along a short axis or from a perspective from a front to a back of the board with the board at a declined angle, according to some embodiments of the present disclosure.

FIG. 9*b* is a schematic diagram illustrating a view of the exercise apparatus along a short axis or from a perspective from a front to a back of the board with the board position at a declined angle, according to some embodiments of the present disclosure. Board 89 is elevated by a wedge 92, that positioned the top sliding surface 89 at an incline, along with the foot contact bumper 88*b*, shock-absorbing system 86*b*, and contact base plate 84*b*.

When the top sliding surface 89 is positioned at a declined slope for simulating a backward ice-skating for backward skating, the user would face the wall where the guiding system is attached. It has nothing to do with inclined or declined board on the top sliding surface 89, the guiding system simultaneously guides an amount of a user-uphill sloped motion to correspond to a portion of a user-selected path of sloped motion that is uphill including when the sloped user pushes off from one of the opposing bumpers to travel uphill to a midpoint of the user-selected path of sloped motion. Then the guiding system simultaneously guides an amount of a user-downhill motion to correspond to a portion of the user-selected path of sloped motion that is downhill from the midpoint of the user-selected path of sloped motion including when the sloped user travels downhill to the opposing bumper. While the guiding system continually simulates, a body dynamic of a naturally occurring sloped posture and motion of a human's body on the top sliding inclined slope surface optimized for performing the top sliding declined slope surface activity.

The user utilizes the board in a similar fashion to the standard forward use, but instead, is facing backwards and slides back-and-forth between the foot strike bumpers. This mode of usage of this slide board allows for the training and conditioning of different muscle groups in comparison to the forward-facing training technique. This expands the utility of this type of training apparatus. In one scenario to be envisioned, this mode of use can be seen as simulating the backward ice-skating motion seen commonly in the act of ice-skating. This allows a user to train the backwards skating technique and backwards skating muscles.

Still referring to FIG. 9*b*, the ability for the user to use the board in a backward facing position is only achievable because of the guiding system provided by the counter force to a force of a user lean (i.e., leaning slightly backwards during this training technique). A slide board without the guiding system would not allow a backward skating simulation, since the user upon generating a user lean force could fall to the ground without the counterforce provided by the restraining feature. The ability to reverse the direction of the bodily lean by 180° is unique when compared to conventional slide board structures and configurations. For non-ice skaters, the usage of the exercise apparatus of the present disclosure to be used this manner would provide these users with a fitness training that would be directed to different muscles than would otherwise be achievable without the ability to lean backwards against the counter force of the restraining device.

Definitions

According to aspects of the present disclosure, and based on experimentation, the following definitions have been established, and certainly are not the complete definition of each phrase or term. Wherein the provided definitions are merely provided as an example, based upon learnings from experimentation, wherein other interpretations, definitions, and other aspects may pertain. However, for at least a mere basic preview of the phrase or term presented, such definitions have been provided. Further, the definitions below cannot be viewed as prior art since the knowledge gained is from experimentation only.

Slide Board": a flat, low friction solid surface that is approximately 0.75" by 42" by 84"; this essentially rectangular surface lies on the flat ground; the slide board user slides back and forth on this low friction surface on his or own feet. This term may be interchangeably used with the term "board", or "Slideboard".

"Foot contact bumper" is used interchangeably with the term "foot strike bumper" and each of these terms is used interchangeably with the truncated term "bumper". The slide board user's foot strikes this component after he or she slides across the surface of the slide board in one direction. This bumper component decelerates the user and provides for a push-off location as the user changes direction and pushes off to glide across the slide board in the opposite direction from where he or she just came.

"Counterforce and Guiding System" involves a rope or cord or cable that is attached on either end to rigid or semirigid fixation points, one of which is behind and to the left of the user and one of which is behind and to the right of the user (or, in a version in which there is only one fixation point, this device would be attached directly behind the user); this rope or cord or cable passes through one or more pulleys that are affixed to the slide board user's lower torso. The dynamic restraining device acts as a guiding force as the user slides back and forth on the slide board. And, because the cord or the rope or the cable passes through pulley(s) or ring, the user can glide along the course of the rope or the cable or the cord (i.e. due to the ring fixed to the harness and the cord is not affixed statically to the user; the user can glide on the path of the rope or cord or pulley).

"User" means the person who is using the slide board, and this term is used interchangeably with the term "slide board user".

The description provides exemplary embodiments only, and is not intended to limit the scope, applicability, or configuration of the disclosure. Rather, the following description of the exemplary embodiments will provide those skilled in the art with an enabling description for implementing one or more exemplary embodiments. Contemplated are various changes that may be made in the function and arrangement of elements without departing from the spirit and scope of the subject matter disclosed as set forth in the appended claims.

What is claimed is:

1. An exercise apparatus system comprising:

a board with a front, a back, and a top sliding surface from first and second opposing side ends;

bumpers with shock-absorbing systems adjustably attached to locations on the top sliding surface on the first and the second opposing side ends, respectively, that include a variable length between the bumpers and variable push-off angles of the bumpers, respectively, wherein each bumper includes an adjustable base plate connectable to the locations on the top sliding surface such that altering an orientation of each bumper adjustable base plate at the locations on the top sliding surface changes an amount of the variable length between the bumpers and the variable push-off angles and is configured to result in changing stride mechanics of a user or a stride angle of the user on the top sliding surface; and a counterforce and guiding system configured to simultaneously provide:

an amount of counterbalancing force corresponding to a first amount of force by an amount of a lean force by the user during a sliding motion between one bumper of the bumpers and an opposing bumper of the bumpers on the top sliding surface; and an amount of a guiding force from at least one harness worn by the user that is not affixed statically, to allow a motion of the user to freely glide on a path of motion of a guideline and guided with a second amount of force to overcome an amount of the motion of the user corresponding to a user-selected path of motion on the top sliding surface as the user slides between the one bumper and the opposing bumper;

wherein a combination of the adjustability of the bumpers and effects of the guiding force from the counterforce and guiding system are configured to result in the user simulating a body dynamic of a naturally occurring posture and motion of a human body optimized for performing an optimized path of motion corresponding to the user-selected path of motion while preventing the user from traveling off the board resulting in an injury;

wherein each bumper location on the top sliding surface, the variable length between the bumpers, and each bumper variable push-off angle are configured to be determined by the user-selected path of motion based on characteristics of the user and a user-selected simulated training exercise; and wherein the characteristics of the user include a height of the user and the user-selected simulated training exercise includes one of ice skating, figure skating, speed skating, downhill skiing, skate-skiing, cross-country skiing, rollerblading, and cross-training fitness activities.

2. The exercise apparatus system of claim 1, wherein the exercise apparatus system is configured such that a change of the stride mechanics of the user, the stride angle of the user on the top sliding surface, or both, results in the user simulating a change in an amount of a body energy of the user to perform one or more of the user-selected simulated training exercises, a change in an amount of energy to one or more lower extremity muscle groups of the user to perform the one or more of the user-selected simulated training exercises, or a change in an amount of energy to a portion of the one or more lower extremity muscle groups to perform the one or more of the user-selected simulated training exercises.

3. The exercise apparatus system of claim 1, wherein altering the orientation of each bumper adjustable base plate along a long axis in a direction from the first and the second opposing side ends of the board, along a short axis from the front to the back of the board, or both, changes one of the variable length between the bumpers, the variable push-off angles, or both.

4. The exercise apparatus system of claim 1, wherein each bumper includes a foot contact bumper with a structure and configuration that allows for a free-floating effect, allowing for a dynamic, individualized accommodation of 0 to 10-degree adjustability to each foot contact bumper, that is in addition to the variable push-off angles of the bumpers set by the user-selected path of motion, wherein the structure of the foot contact bumper is one of rigid, semi-rigid, or a degree of flexibility configured to be based upon the characteristics of the user and the user-selected simulated training exercise that results in the user simulating an enhanced body dynamic of the naturally occurring posture and motion of the human body optimized for performing the user-selected simulated training exercise.

5. The exercise apparatus system of claim 1, wherein each adjustable base plate is connected to an end of the respective shock-absorbing system, another end of the respective shock-absorbing system extends to a foot contact bumper, the foot contact bumper is free-floating while constrained between two support devices allowing the foot contact bumper to slide symmetrically and in parallel, and also provides for a dynamic, individualized accommodation of 0 to 10-degrees push-off angles for each foot contact bumper while being configured to provide a force absorbing effect when a foot of the user impacts the foot contact bumper.

6. The exercise apparatus system of claim 1, wherein each adjustable base plate is connected to an end of the respective shock-absorbing system, another end of the respective shock-absorbing system extends to a foot contact bumper configured to provide a force absorbing effect when a foot of the user impacts the foot contact bumper, wherein the foot contact bumper is free-floating while constrained between two support devices allowing the foot contact bumper to slide symmetrically and in parallel when an impact force of the foot of the user impacts the foot contact bumper, such that the two support devices prevent the foot contact bumper from deflecting, lifting, moving in an upwards direction, or off of the top sliding surface of the board when the foot contact bumper is impacted by an amount of force by the foot of the user.

7. The exercise apparatus system of claim 1, wherein each adjustable base plate is connected to an end of the respective shock-absorbing system, another end of the respective shock-absorbing system extends to a foot contact bumper, an end of the foot contact bumper is attachable at the locations on the top sliding surface, another end of the foot contact bumper is unattached to the top sliding surface and freely rotates around an attached location on the top sliding surface or at a pivot point thereof, the unattached end of the foot contact bumper being configured to provide a force absorbing effect when an amount of foot impact force by a foot of the user impacts the foot contact bumper.

8. The exercise apparatus system of claim 1, wherein each adjustable base plate is connected to an end of the respective shock-absorbing system, another end of the respective shock-absorbing system extends to a foot contact bumper, an end of the foot contact bumper is attachable at the locations on the top sliding surface, another end of the foot contact bumper is unattached to the top sliding surface and freely rotates around an attached location on the top sliding surface, such that altering an orientation location of the attached end of the foot contact bumper on the top sliding surface is configured to allow for adjustments to a length of travel by the user on the top sliding surface between the one bumper and the opposing bumper.

9. The exercise apparatus system of claim 1, wherein each adjustable base plate is connected to a foot contact bumper, such that a change in an angle of each adjustable base plate on the top sliding surface changes a relative angle of the foot contact bumper along a long axis in a direction from the first and the second opposing side ends of the board, a short axis from the front to the back of the board, or both, which is configured to allow for variations in an angle at which a foot of the user impacts the foot contact bumper, and further changes an angle of push-off from the foot contact bumper by the user, wherein the angle of push-off by the user includes one of, 0 to 15 degrees, 15 to 30 degrees, 30 to 45 degrees, 45 to 52 degrees, or greater than 52 degrees.

10. The exercise apparatus system of claim 1, wherein each adjustable base plate is connected to the respective shock-absorbing system that is in communication with a foot contact bumper, such that an amount of tension of the respective shock-absorbing system is configured to be based upon the characteristics of the user and the user-selected simulated training exercise, to provide for an amount of push-off force in addition to an amount of push-off force by a foot of the user from the foot contact bumper, to provide an amount of greater force by the foot of the user during the push-off of the user from the foot contact bumper, or an amount of increased energy of the user, required for the user to generate an amount of momentum to travel across the user-selected path of motion on the top sliding surface as the user slides between the one bumper and the opposing bumper.

11. The exercise apparatus system of claim 1, wherein each adjustable base plate is connected to the respective shock-absorbing system that is in communication with a foot contact bumper, such that an amount of tension of the respective shock-absorbing system is configured to be based upon the characteristics of the user and the user-selected simulated training exercise, to reduce and dissipate an amount of unwanted forces to one or more parts of a body of the user including an ankle, a knee, a hip, a spine, and a foot of the user, to prevent an injury.

12. The exercise apparatus system of claim 1, wherein each adjustable base plate is connected to the respective shock-absorbing system that is in communication with a foot contact bumper, a structure of the foot contact bumper is one of rigid, semi-rigid, or a degree of flexibility configured to be based upon the characteristics of the user and the user-selected simulated training exercise, that results in the user simulating an enhanced body dynamic of the naturally occurring posture and motion of the human body optimized for performing the user-selected simulated training exercise.

13. The exercise apparatus system of claim 1, wherein each shock-absorbing system includes variable-rate technical springs, the variable-rate technical springs configured to mimic a natural motion and an amount of a tension force of human muscles and joints, each shock-absorbing system configured to adjust a spring rate force of the variable-rate technical springs based on a limb movement and an amount of a load requirement of the human muscles and joints, to result in simulated human body movements and the amount of tension force of the human muscles and joints and an amount of load from the human muscles and joints, to optimize a reduction in a number of injuries to the user, and to optimize a functionality of the exercise apparatus system.

14. The exercise apparatus system of claim 1, wherein when the top sliding surface is positioned at an inclined slope, the counterforce and guiding system is configured to simultaneously guide an amount of an uphill sloped motion of the user to correspond to a first portion of a curved arc of sloped motion that is uphill including when the user pushes off from one of the one bumper and the opposing bumper to travel uphill to a midpoint of the curved arc of sloped motion, then the counterforce and guiding system is configured to simultaneously guide an amount of a downhill motion of the user to correspond to a second portion of the curved arc of sloped motion that is downhill from the midpoint of the curved arc of sloped motion including when the user travels downhill to the other of the one bumper and the opposing bumper, while the counterforce and guiding system is configured to continually simulate a second body dynamic of a naturally occurring sloped posture and motion of a human body on the top sliding surface positioned at the inclined slope optimized for performing the user-selected simulated training exercise.

15. The exercise apparatus system of claim 1, wherein when the top sliding surface is positioned at a declined slope for simulating a backward ice-skating exercise on the top sliding surface, the counterforce and guiding system is configured to simultaneously guide an amount of an uphill sloped motion of the user to correspond to a first portion of a curved arc of sloped motion that is uphill including when the user pushes off from one of the one bumper and the opposing bumper to travel uphill to a midpoint of the curved arc of sloped motion, then the counterforce and guiding system is configured to simultaneously guide an amount of a downhill motion of the user to correspond to a second portion of the curved arc of sloped motion that is downhill from the midpoint of the curved arc of sloped motion including when the user travels downhill to the other of the one bumper and the opposing bumper, while the counter-force and guiding system is configured to continually simulate a second body dynamic of a naturally occurring sloped posture and motion of a human body on the top sliding surface positioned at the declined slope optimized for performing the backward ice-skating exercise.

* * * * *